United States Patent [19]

Hall

[11] Patent Number: 4,865,303

[45] Date of Patent: Sep. 12, 1989

[54] OPERATING TABLE

[75] Inventor: George D. Hall, Erie, Pa.

[73] Assignee: American Sterilizer Company, Erie, Pa.

[21] Appl. No.: 124,238

[22] Filed: Nov. 23, 1987

[51] Int. Cl.[4] ..... A61G 13/00

[52] U.S. Cl. ..... 269/325

[58] Field of Search ..... 269/322–327

[56] References Cited

U.S. PATENT DOCUMENTS 3,281,141 10/1966 Smiley ..... 269/325

FOREIGN PATENT DOCUMENTS 3016387 11/1981 Fed. Rep. of Germany ..... 269/325

2133678 8/1984 United Kingdom ..... 269/325

*Primary Examiner*—Gene Wan

*Attorney, Agent, or Firm*—Kirkpatrick & Lockhart

[57] ABSTRACT

The present invention relates to a surgical table having a minimum number of function levels, pivot points and actuators and which is capable of achieving all desired surgical table movements. The surgical table includes a base portion which supports a vertical column whose height is adjustable by means of a first actuator. Pivotally supported at the top of the vertical column is a lateral tilt supporting level which may be tilted relative to the column by means of a second actuator. The lateral tilt level supporting structure is provided with a double acting hinge which supports the table top. The table top includes a back section and a seat section which are each attached to the pivot means. The back section may be pivoted relative to the pivot point by means of a third actuator, while the seat section may be pivoted relative to the pivot point by means of a fourth actuator. A leg section is pivotally attached to the seat section and may be pivoted relative thereto by means of a fifth actuator. In addition, a control means including a plurality of valves is disclosed which are effective to connect a plurality of hydraulic valves between a source of hydraulic fluid, a drain for hydraulic fluid and the cap ends and the rod ends of the respective valves to move the table into all desired positions.

26 Claims, 22 Drawing Sheets

OPERATING TABLE

BACKGROUND OF THE INVENTION

1. Field of the Invention

The present invention relates to surgical tables and, in particular, to a surgical table having an articulated table top and actuators and controls therefor for supporting a patient in all desired positions.

2. Description of the Invention Background

Heretofore, various surgical tables have been developed in order to allow a surgical patient to be supported and positioned for surgical operations. The variety of modern surgical techniques available mandates that surgical tables be capable of performing the following functions: (i) the raising and lowering of the patient support surface; (ii) the left and right lateral tilting of the patient support surface; (iii) the independent raising and lowering of the back, seat and leg sections of the patient supporting surface; (iv) the adjustment of the patient support surface into the Trendelenburg position (head down, feet up) and reverse Trendelenburg position (head up, feet down); and (v) the adjustment of the patient support surface into the flex position (head down, midsection up, feet down) and reflex position (head up, midsection down, feet up).

While prior art surgical tables have been constructed which allow such tables to achieve the foregoing functions, Applicant has found that such tables require an inordinate number of function levels, pivot points and actuators to accomplish such movements. The term "function level" as used in the instant specification is intended to refer to those discrete vertical planes of table and/or patient supporting structures within the surgical table.

One prior surgical art table has been manufactured by Affiliated Hospital Products, Inc. under the name Radiop Model 1500. In that surgical table, an adjustable vertical column was mounted on the base of the surgical table, and the height of the column could be varied by means of a first activator in the form of a hydraulic cylinder. A Trendelenburg level supporting structure was supported on the top of the column for pivotal movement relative to the column by means of a second actuator connected between the column and the Trendelenburg level supporting structure. A lateral tilt supporting structure was pivotally supported on the Trendelenburg level supporting structure for pivotal movement with respect thereto by means of a third hydraulic actuator. In addition, a top level supporting structure was attached to the lateral tilt level supporting structure. The top level structure included a seat section which was secured to the lateral tilt level supporting structure. A back supporting section was pivotally attached to the seat section for pivotal movement relative thereto by means of a fourth actuator. Further, a leg section was pivotally attached to the seat section for pivotal movement relative thereto by means of a fifth actuator. As such the Radiop Model 1500 surgical table accomplished the enumerated surgical table functions by means of a structure which included four discrete function levels, four pivot points and five actuators.

American Sterilizer Company, the assignee of the instant application, has also produced a surgical table capable of accomplishing all of the above-identified surgical table functions. That surgical table, identified as Model 2080, includes a base supporting structure which supports the remaining table structure. A variable height column is affixed to the base structure with the height of the column being adjustable by means of a first actuator. A lateral tilt supporting level is supported on the upper portion of the vertical column by a hinge means. A second actuator serves to laterally tilt the lateral tilt level supporting structure relative to the column by means of a second actuator. A Trendelenburg position supporting level is pivotally attached to the lateral tilt level supporting structure and is pivotable relative thereto by means of a third actuator.

In the Model 2080 surgical table, a top level supporting structure is attached to the Trendelenburg level structure and includes a seat section pivotally attached to the Trendelenburg level supporting structure. The seat section may be pivoted relative to the Trendelenburg level supporting structure by means of a fourth actuator. A back section is pivotally attached to the seat section and is pivotable relative thereto by means of a fifth actuator connected intermediate the Trendelenburg level supporting structure and the back section. Further, a leg section is pivotally attached to the seat section and is pivotable relative thereto by means of a sixth actuator connected between the Trendelenburg level and the leg section. To accomplish the flex and reflex positions, the Model 2080 surgical table requires the mechanical coupling of the actuators for the back and seat sections. Accordingly, it will be recognized that the American Sterilizer Company Model 2080 surgical table includes four function levels, five pivot points and six actuators to accomplish the required patient positioning.

While some prior art surgical tables accomplish the requisite range of movements, Applicant has discovered that the increased number of actuators, pivot points and function levels therein has increased the cost of such tables. In addition, it will be readily appreciated that the inclusion of additional function levels, pivot points and actuators lessens the overall rigidity of the surgical table. Further, the number of function levels, pivot points and actuators in such tables has necessarily decreased the functional reliability of such tables to some degree.

In addition, all of the prior art surgical tables provide the Trendelenburg feature by either adding a discrete Trendelenburg function level between the column and table top or by requiring the independent adjustment of two table top sections. When a discrete Trendelenburg function level is incorporated, the cost of the table is necessarily increased while table rigidity and reliability decreases. Alternatively, when a surgical table requires the independent adjustment of top sections to achieve the Trendelenburg position, the surgical table does not provide the foolproof manipulation of the respective table top sections to achieve that position.

The subject invention is directed toward an improved surgical table which overcomes, among others, the above-discussed shortcomings of prior art surgical tables and provides a surgical table which achieves the full range of patient positioning alternatives while minimizing the number of function levels, pivot points and actuators. As such, the present invention provides a moderate cost, rigid and reliable surgical table.

SUMMARY OF THE INVENTION

In accordance with the present invention, there is provided an improved surgical table having a minimum number of function levels, pivot points and actuators to achieve the required table positions. As is described below, the surgical table constructed according to the present invention accomplishes the full range of surgical table movements while employing only three function levels, three pivot points and five actuators.

The surgical table constructed according to the present invention includes a base level for supporting the table's patient positioning structure. A variable height column is supported on the base supporting structure and is provided with a first actuator for adjusting the column height. A lateral tilt support structure is pivotally attached to the upper portion of the column and is pivoted relative thereto by means of a second actuator. A dual-acting hinge means is, in turn, supported by the lateral tilt level supporting structure. A back section is pivotally mounted on the hinge means and may be adjusted relative to the lateral tilt level supporting structure by means of a third actuator. A seat section is also pivotally attached to the lateral tilt level supporting structure and is pivotable relative thereto by means of a fourth actuator. Additionally, a leg section is pivotally attached to the seat section and may be pivoted relative thereto by means of a fifth actuator.

By the operation of the first actuator, the table top height may be adjusted. By means of the actuation of the second actuator the table top may be laterally tilted to the right and to the left. In addition, the leg section may be raised or lowered relative to the seat section by means of the fifth actuator. However, in order to accomplish the raising and lowering of the back section, the raising and lowering of the seat section, Trendelenburg, reverse Trendelenburg, flex and reflex positions, Applicant has invented a control means for controlling the operation of the third and fourth actuators.

The control means includes a series of electric solenoid valves and pilot operated check valves to accomplish table top positioning. For the raising and lowering of the back section, the valves of the control means are appropriately connected between a source of pressurized hydraulic fluid and a hydraulic fluid reservoir. Similarly, for the raising and lowering of the seat section, the valves of the control means connect a source of hydraulic fluid under pressure and the reservoir with the fourth actuator. In order that the surgical table may achieve the Trendelenburg position, the valves of the control means connect the source of pressurized hydraulic fluid with one side of the fourth actuator to raise the seat section while the hydraulic fluid from the other chamber of the fourth actuator passes to one side of the third actuator to lower the back section. The hydraulic fluid displaced from the third actuator is, in turn, passed to the reservoir. For the surgical table to achieve the reverse Trendelenburg position, the third actuator is connected to the source of hydraulic fluid by the valves of the control means to raise the back section. The fluid displaced from the third actuator is provided to the fourth actuator to lower the seat section with the same rate of motion. For flex actuation of the present surgical table, the valves of the control means serve to connect the third actuator with the source of pressurized hydraulic fluid to lower the back section. Simultaneously the fluid displaced from the third actuator is provided to the fourth actuator to lower the seat section at a more rapid rate. For the surgical table constructed according to the present invention to achieve the reflex position, the fourth actuator is connected by the valves of the control means to the source of the hydraulic fluid under pressure in order that the fourth actuator causes the seat to be raised while the hydraulic fluid displaced from the other chamber of the fourth actuator is provided to the third actuator to raise the back section at a slower rate of motion.

As such, by virtue of the structure of the surgical table provided herein, all surgical table functions may be achieved while the number of function levels, pivot points and actuators is reduced from those appearing in prior art surgical tables. As the number of function levels, pivot points and actuators is reduced, the present surgical table may be produced at a more moderate cost while providing a more rigid structure. In addition, the minimization of such components allows a more reliable operation of a surgical table.

Accordingly, the present invention provides solutions to the aforementioned problems present with prior art surgical tables. As this invention provides an effective means of providing the complete range of surgical table functions while minimizing the number of function levels, pivot points and actuators, a more moderately priced, more reliable and more rigid surgical table is provided.

These and other details, objects and advantages of the present invention will become apparent as the following description of the present preferred embodiment thereof proceeds.

BRIEF DESCRIPTION OF THE DRAWINGS

In the accompanying drawings, I have shown a present preferred embodiment of the invention wherein.

DETAILED DESCRIPTION OF THE PREFERRED EMBODIMENTS

Figure 3:
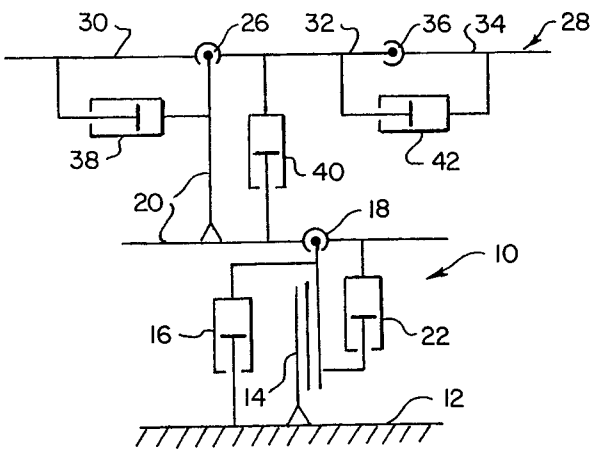
FIG. 3 is a schematic representation of certain components of surgical table according to the present invention.

Referring now to the drawings wherein the showings are for purposes of illustrating the present preferred embodiment of the invention only and not for purposes of limiting same, the Figures show a surgical table 10 constructed according to the present invention.

Figure 1:
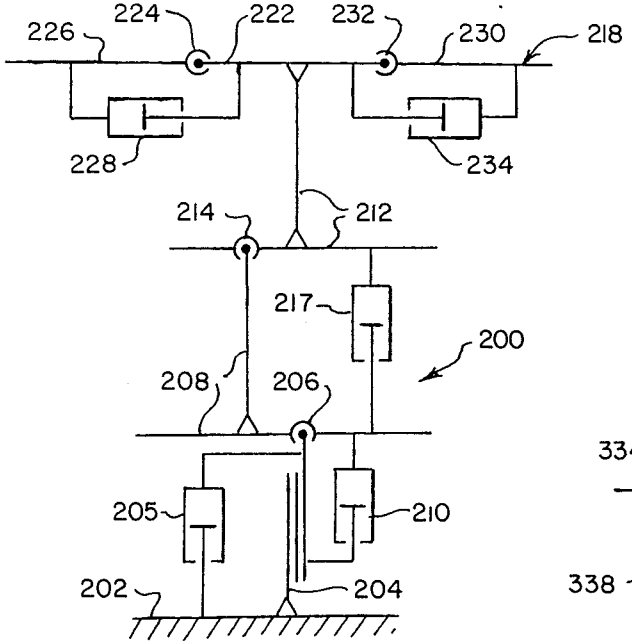
Fig. 1. Prior Art
FIG. 1 is a schematic representation of the components of one prior art surgical table.
Figure 5:
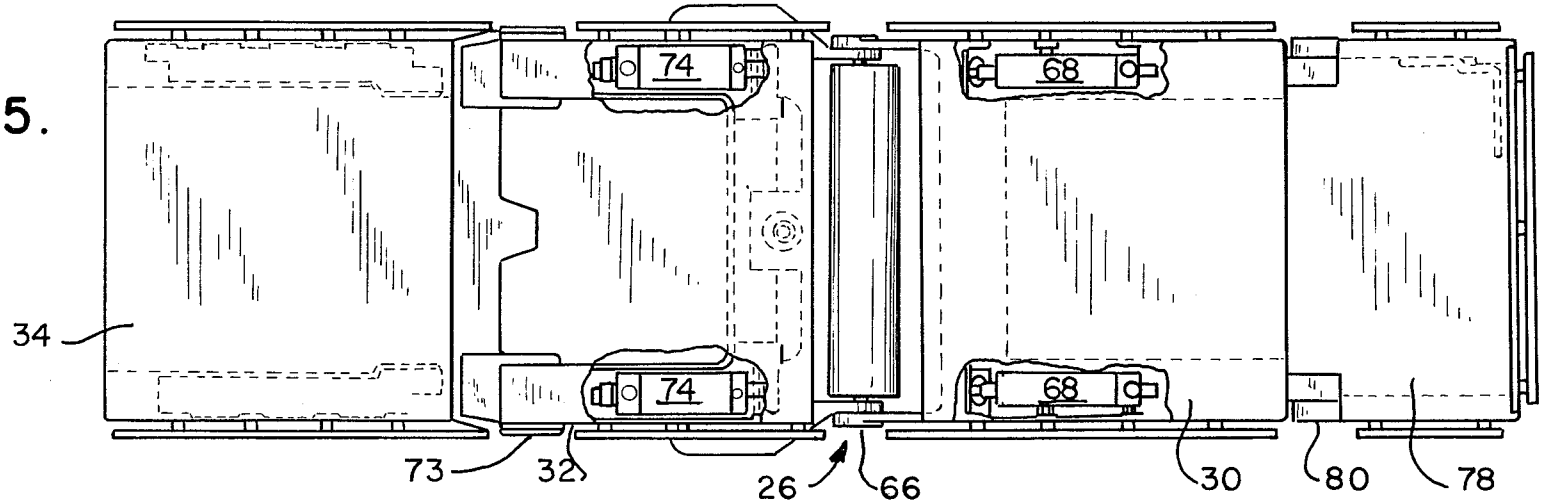
FIG. 5 is a top plan, partial cut-away view of the surgical table according to the present invention.

Before disclosing the details of the structure and operation of the surgical table 10 disclosed herein, the features of two prior art surgical tables will be discussed. More particularly, and with reference to FIG. 1, there is shown a surgical table 200 which has been sold by Affiliated Hospital Products, Inc. under the name Radiop Model 1500 (the "Radiop table"). The Radiop table includes a base portion, generally designated as 202, which comprises a rigid framework supported by the floor surface. The base member 202 comprises the first function level of the Radiop table. A variable height vertical column 204 is affixed to the base member 202. In order to vary the height of the column 204 relative to the base member 202, a first actuator 205 is provided. While each of the actuators of the Radiop table are schematically depicted as hydraulic cylinders, it will be appreciated by those skilled in the art that such actuators may actually comprise mechanical means for achieving the indicated movements.

The upper portion of the column 204 includes a first pivot point 206 which supports the Trendelenburg level supporting structure 208. The Trendelenburg level supporting structure 208 may be pivoted about pivot point 206 by means of a second actuator 210 in order to support the upper components of table 200 in the Trendelenburg or reverse Trendelenburg positions. A lateral tilt supporting level 212 is affixed to the Trendelenburg level supporting structure 208 by means of a second pivot point 214. The tilting of the lateral tilt level supporting structure 212 is powered by a third actuator 217. While the lateral tilt level supporting structure 212 is shown schematically in FIG. 1 as being pivotable in the same plane as the other pivot points, it will be appreciated by those skilled in the art that the lateral tilt level 212 is actually pivotable in a plane disposed at 90° angle relative to the other pivot points.

A top level supporting structure 218 is affixed to the lateral tilt level supporting structure 212 of the table 200. Top level structure 218 includes a seat section 222 affixed to the lateral tilt level supporting sturcture 212. Pivotally attached to seat section 222 by means of a third pivot point 224, is a back section 226. The back section may be pivoted about pivot point 224 relative to seat section 222 by means of a fourth actuator 228. A leg supporting section 230 is pivotally attached to the seat section 222 by means of a fourth pivot point 232. A fifth actuator 234 is connected intermediate the seat section 222 and the leg section 230 in order that the leg section 230 may be pivoted relative to the seat section 222.

In the operation of the table 200, the actuation of actuator 204 causes the height of the table top structure 218 to be adjusted. When second actuator 210 is operated, the Trendelenburg level supporting structure 208 is pivoted relative to base member 202 about pivot point 206. In addition, the lateral tilt level structure 212 may be pivoted about pivot point 214 by means of the actuation of third actuator 217. The seat section 222 is rigidly attached to the lateral tilt level 212 and moves in connection with that level. By the actuation of fourth actuator 228, the back section 226 may be pivoted relative to seat section 222. Further, by the actuation of fifth actuator 232 the leg section 230 may be pivoted relative to the seat section 222.

It is apparent from examination of the table 200 that such table incorporates a dedicated Trendelenburg function level. In addition, the table 200 includes no coordinated flex or reflex functions. To provide the flex posture, the second actuator 210 and the fourth actuator 228 must be independently adjusted. Similarly, to provide the reflex posture, second actuator 210 and fourth actuator 228 must again be independently adjusted. Accordingly, it is apparent that the table 200 includes four function levels, namely, base level 202, Trendelenburg level 208, lateral tilt level 212, and top level 218. The table 200 also includes four pivot points, 206, 214, 224 and 230, respectively. Further, for its operation, the table 200 requires five actuators, namely, first actuator 204, second actuator 210, third actuator 217, fourth actuator 228 and fifth actuator 232.

Figure 2:
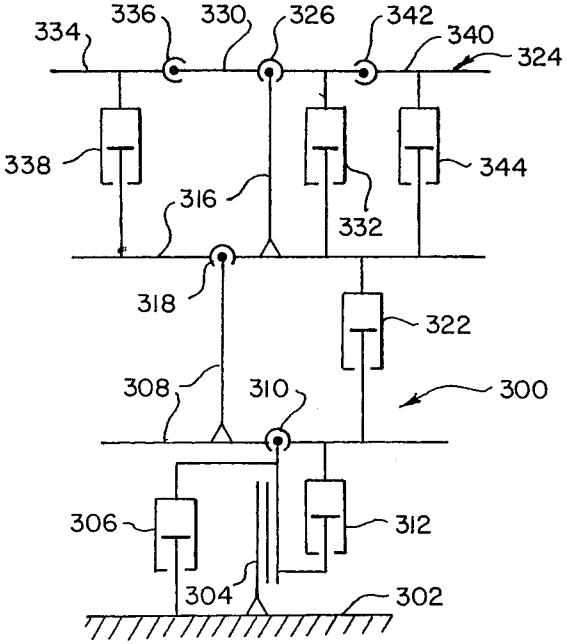
Fig. 2. Prior Art
FIG. 2 is a schematic representation of the components of another prior art surgical table.

Another prior art surgical table is illustrated in FIG. 2 and is generally designated by the numeral 300. Table 300 has been produced by the assignee of the present application, American Sterilizer Company, under the model number 2080. Table 300 includes a base level 302 which supports a vertical adjustable height column 304. The height of column 304 may be adjusted relative to base member 302 by means of a first actuator 306.

Table 300 is provided with a lateral tilt level supporting structure 308, which is attached by a pivot means 310 to the upper portion of column 304. The pivot means 310 is actually disposed at a 90° angle to the other pivot means of table 300. Lateral tilt supporting mechanism 308 may be tilted relative to base 302 by means of the actuation of second actuator 312. In addition, table 300 includes a Trendelenburg level supporting structure 316 which is supported on lateral tilt level supporting structure 308 for pivotal movement about a second pivot point 318 which is supported by lateral tilt level supporting structure 308. Trendelenburg level supporting structure 316 may be pivoted relative to the lateral tilt level supporting structure 308 by means of a third actuator 322. A top level supporting structure generally designated 324 is supported on Trendelenburg supporting structure 316 for pivotal movement about a third pivot point 326 attached to Trendelenburg supporting structure 316. Top level supporting structure 324 includes a seat section 330 attached to pivot point 326. Seat section 330 may be pivoted relative to the Trendelenburg level supporting structure 316 by means of a fourth actuator 332. Seat section 330 supports a back section 334 by means of a fifth pivot point 336. Back section 334 may be pivoted about pivot point 336 by means of a fifth actuator 338. In addition, a leg section 340 is pivotedly attached to the seat section 330 by means of a sixth pivot point 342. Leg section 340 may be pivoted relative to seat section 330 by means of a sixth actuator 344.

As such, table 300 obviously incorporates a dedicated Trendenlenburg level 316 in order that the tabletop 324 may be pivoted into the Trendenlenburg and reverse Trendenlenburg positions by means of the operation of third actuator 322. Table 300 is capable of yielding a coordinated flex function by providing simultaneous actuation of the fifth actuator 332 and the sixth actuator 344. In the schematic representation in FIG. 2 of table 300, the actuators are all depicted as hydraulic actuators. However, second actuator 312, third actuator 322, fourth actuator 332, fifth actuator 338 and sixth actuator 344 are actually worm and gear drive units.

From a review of table 300, it is apparent that such table incorporates four function levels, namely, base level 302, lateral tilt level 308, Trendenlenburg supporting level 316 and top level 324. In addition, table 300 includes five pivot points, namely, 310, 318, 326, 336 and 342. Further, table 300 incorporates six actuators to achieve the desired patient positioning, namely, first actuator 306, second actuator 312, third actuator 322, fourth actuator 332, fifth actuator 338 and sixth actuator 344.

A schematic representation of the surgical table 10 constructed according to the present invention is depicted in FIG. 3. The general configuration of the function levels, pivot points and actuators of table 10 will now be discussed. Table 10 includes a base supporting level 12 which supports the remainder of the components of table 10. A variable height column 14 is supported on base member 12. The height of column 14 may be adjusted by means of a first actuator generally indicated as 16. A first pivot means 18 is attached to the upper portion of vertical column 14. Pivot means 18 supports a lateral tilt level supporting structure, generally designated as 20, for pivotal movement relative to base section 12. While FIG. 3 depicts first pivot means 18 as having an axis parallel to the other pivot means discussed below, first pivot means 18 is actually disposed at a 90° angle relative to the other pivot means. Lateral tilt level supporting structure 20 may be tilted to the right and to the left relative to base section 12 about first pivot means 18 by means of a second actuator 22.

A second pivot means 26 is connected to the lateral tilt level supporting structure 20. Second pivot means 26 comprises a dual operating hinge means which supports the top level supporting structure, generally designated as 28. Top level supporting structure 28 includes a back section 30 which is pivotally supported by second pivot means 26. Top level supporting structure 28 also includes a seat section 32 which is also pivotally supported by second pivot means 26. Top supporting structure 28 also includes a leg section 34 which is pivotally supported by the seat section 32 by means of a third pivot point 36.

Back section 30 may be pivoted relative to lateral tilt level supporting structure 20 by means of a third actuator, generally 38, horizontally connected between the back section 30 and the lateral tilt level supporting structure 20. The seat section 32 may be pivoted relative to the column 24 by means of a vertical fourth actuator, generally 40, connected between seat section 32 and lateral tilt level supporting structure 20. In addition, a fifth actuator, generally 42, is connected between leg section 34 and seat section 32 to provide relative pivoting of leg section 34 about third pivot means 36.

By means of the construction of surgical table 10 and the operation of the control means discussed hereinbelow, surgical table 10 may achieve the full range of surgical table positions. However, surgical table 10 achieves the wide range of movements while employing only three function levels, namely, base section 12, lateral tilt level supporting structure 20 and top level 28. Further, table 10 requires only three pivot points, namely, first pivot means 18, second pivot means 26 and third pivot means 36. In addition, table 10 requires only five actuators, namely first actuator 16, second actuator 22, third actuator 38, fourth actuator 40 and fifth actuator 42 to achieve the complete range of desired surgical table movements.

Reference will now be made to the remaining Figures for a detailed description of the structure, control and operation of surgical table 10.

Figure 4:
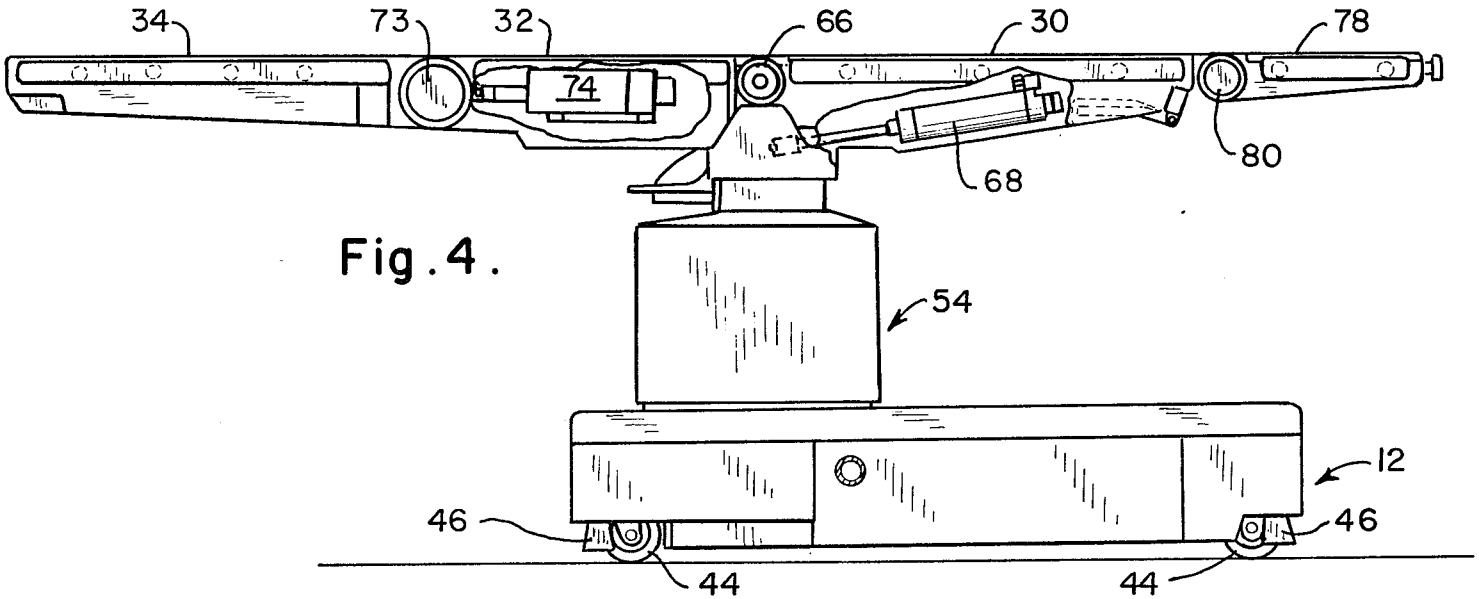
FIG. 4 is a side elevation, partial cut away view of the surgical table according to the present invention.
Figure 7:
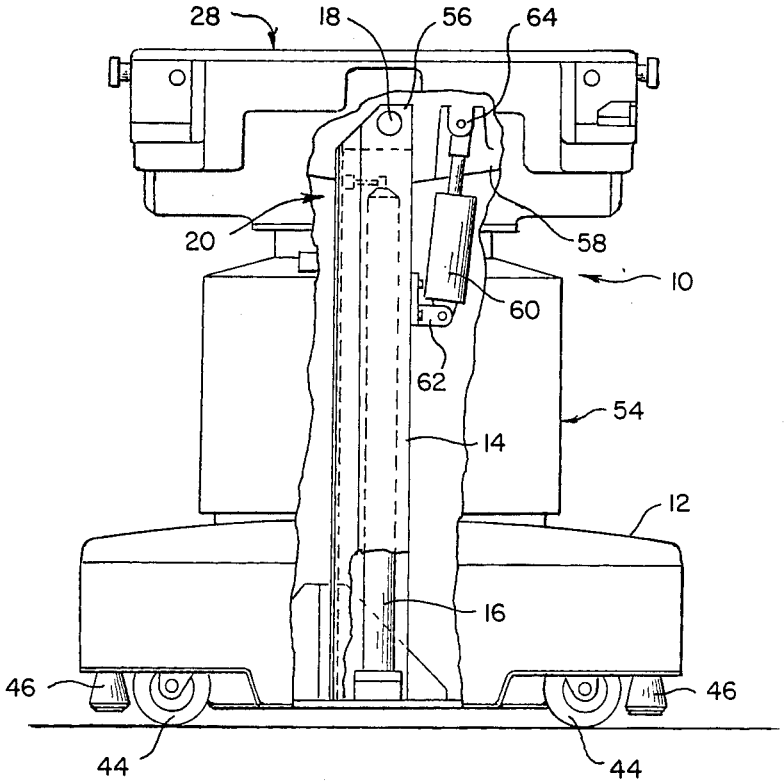
FIG. 7 is an end elevation, partial cut away view of the surgical table of the present invention as viewed from the head end.
Figure 6:
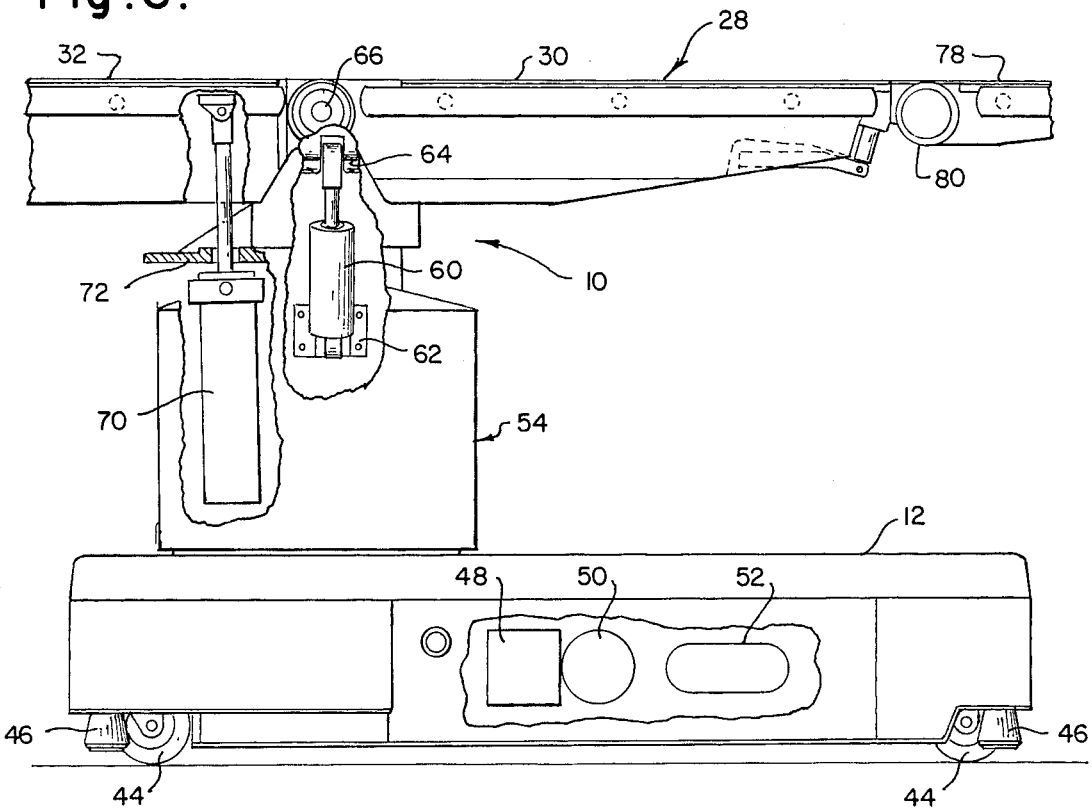
FIG. 6 is a partial side elevation, partial cut away view of the present surgical table.
Figure 8:
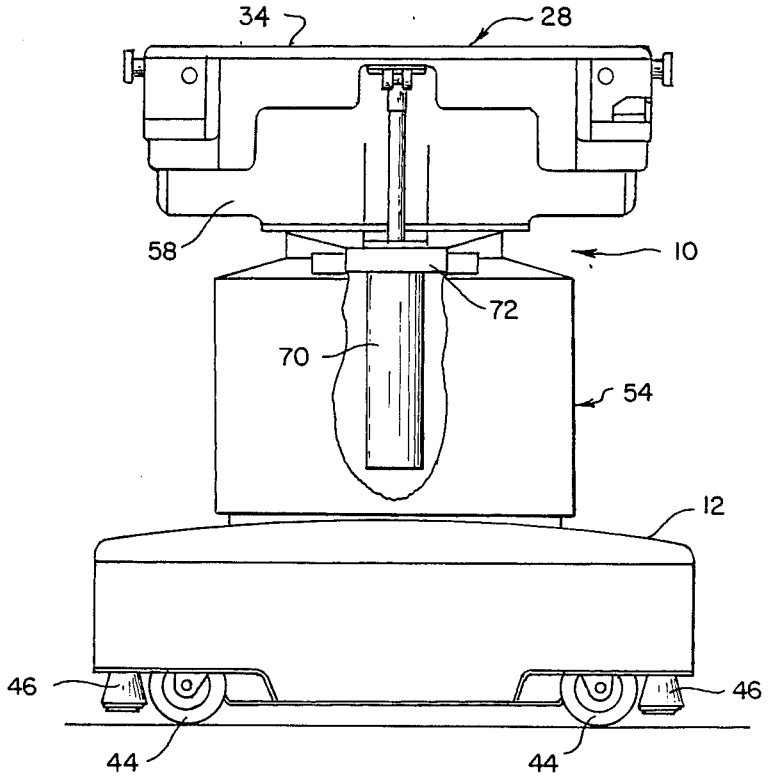
FIG. 8 is an end elevation, partial cut away view of the surgical table of the present invention as viewed from the foot end.

In FIG. 4, there is shown an overall rendering of surgical table 10. As indicated above, base member 12 provides the supporting structure for all components of surgical table 10. Base member 12 includes a downwardly extending portion which supports wheeled casters 44 to allow table 10 to be portable. However, in the event surgical table 10 is desired to be fixed in a given location, such as within an operating suite, supporting legs 46 may be lowered by means known to those skilled in the art to support surgical table 10 thereon. Base member 12 also supports an electrically powered motor 48 which may drive a hydraulic pump 50. As is described hereinbelow, the output of pressurized hydraulic fluid from pump 50 may control the actuation of first, second, third, fourth and fifth actuators 16, 22, 38, 40 and 42, respectively. A reservoir 52 for hydraulic fluid is also provided on base member 12.

Figure 9:
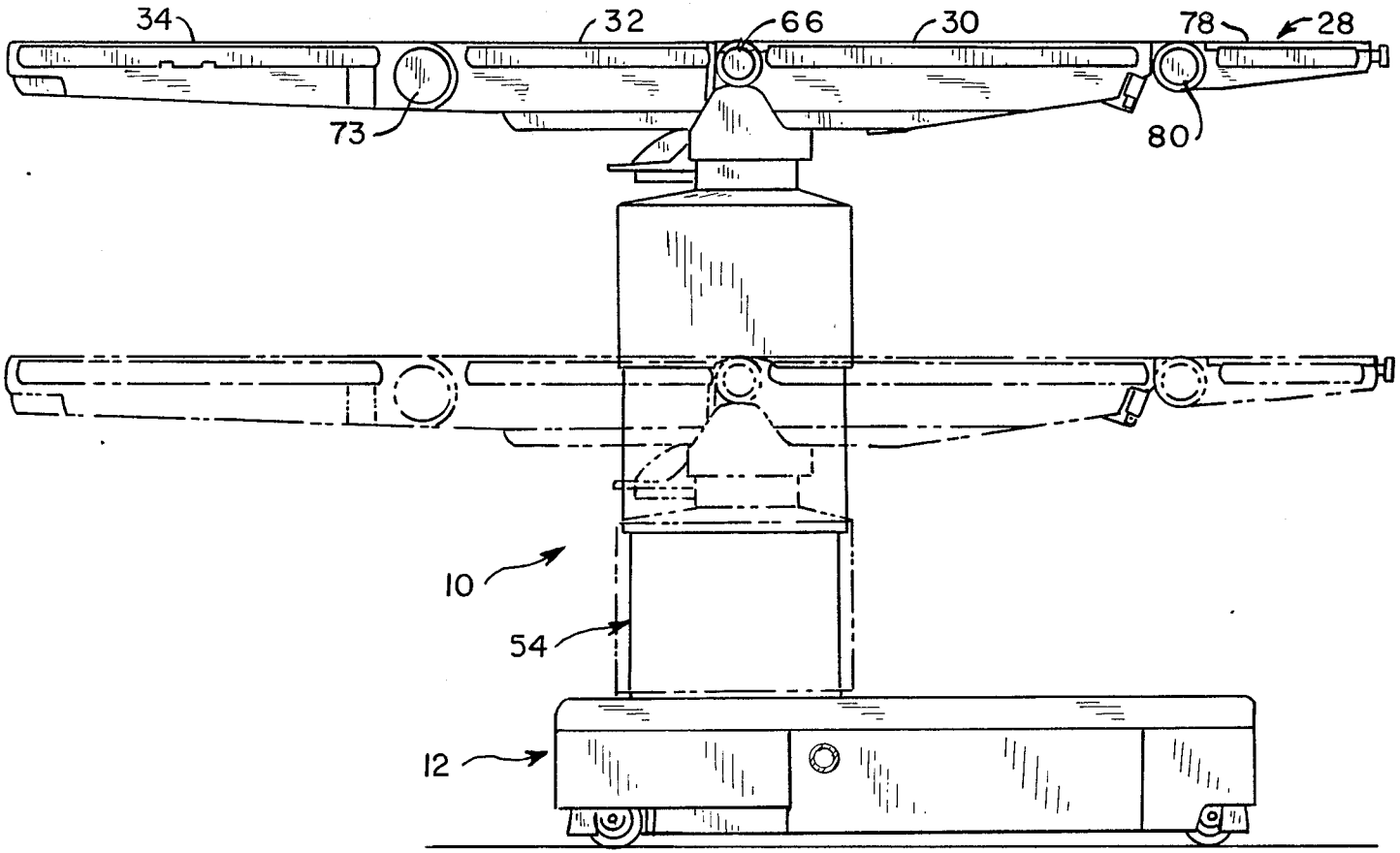
FIG. 9 is a side elevation view of the surgical table of the present invention in its raised and lowered positions.

Rigidly attached to base member 12 is the variable height column 14. Column 14 passes from base section 12 through an intermediate shroud 54 and supports the remaining moveable components of surgical table 10. The first actuator 16 comprises a single acting hydraulic cylinder which is connected at one end to base member 12 and has its housing integrated into the upper portion of variable height column 14. As such, by the extension and retraction of first actuator 16, the height of column 14 may be varied as shown in FIG. 9.

Figure 10:
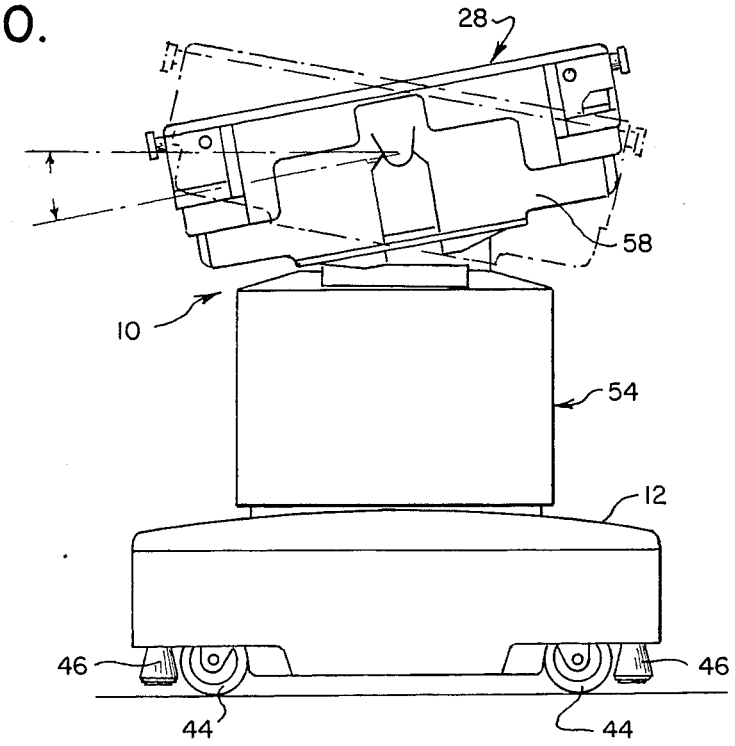
FIG. 10 is an end elevation view of the surgical table of the present invention showing its lateral tilt capabilities.

A yoke 56 is provided at the upper portion of column 14. Yoke 56 supports first pivot means 18, such as a hinge, which, in turn, supports the lateral tilt supporting structure 20. Lateral tilt supporting structure 20 comprises a framework 58 which supports the top structure 28. Second actuator 22 comprises a hydraulic cylinder 60 which is pivotally attached at its cap end to a bracket 62 attached to column 14. The rod end of second cylinder 60 is pivotally attached to a yoke 64 which depends from the lateral tilt framework 58. Accordingly, when pressurized hydraulic fluid is provided to second hydraulic cylinder 60, the lateral tilt framework 58 is pivoted about first pivot means 18 to the right or to the left of the center line of surgical table 10 as is shown in FIG. 10.

Figure 11:
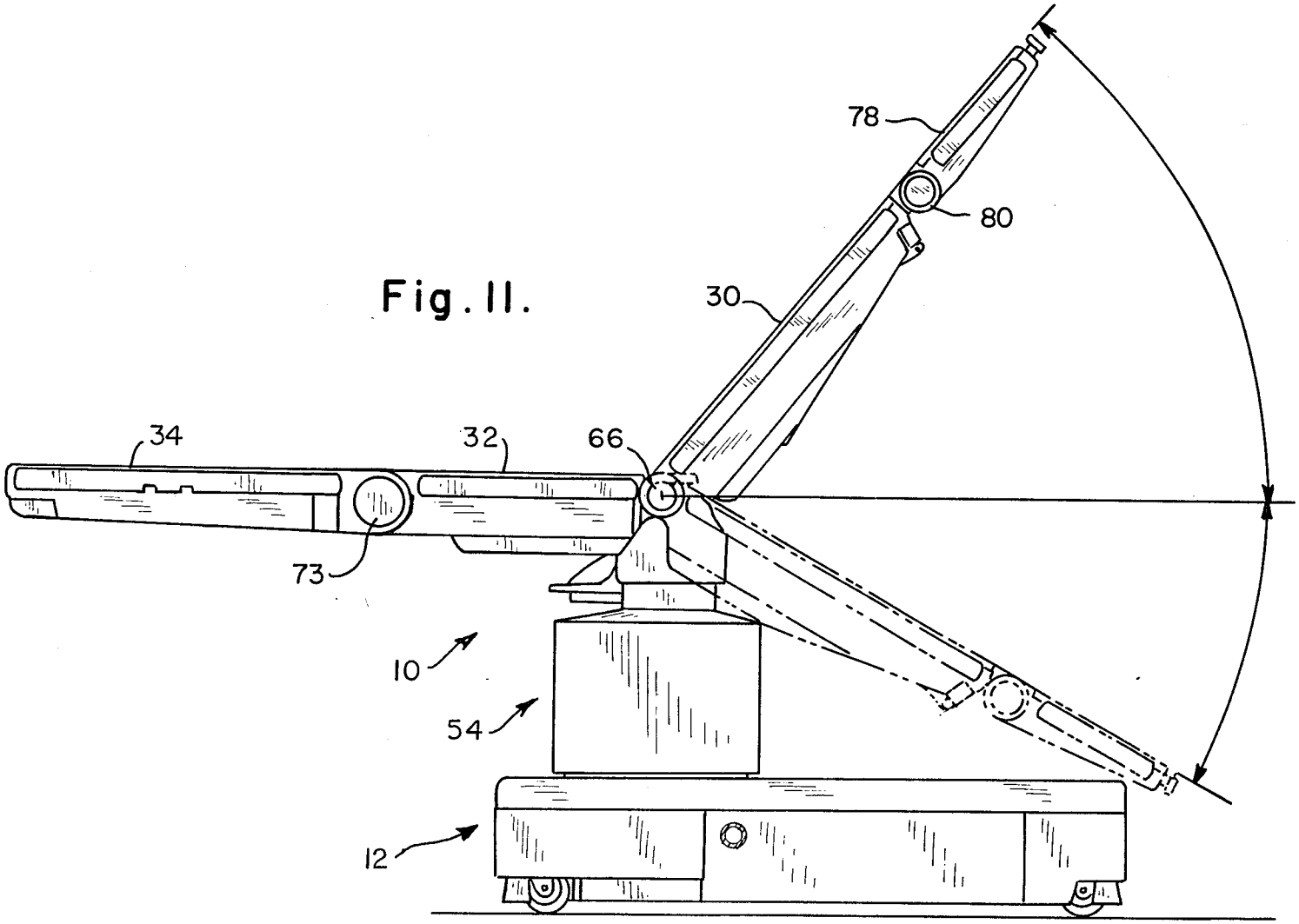
FIG. 11 is a side elevation view of the present surgical table showing its back up and back down positions.

The second pivot means 26 is also supported by the frame 58 of the lateral tilt supporting structure 20. Second pivot means 26 includes a double acting hinge means 66 which allows the pivoting of seat section 32 and back section 30 relative to lateral tilt supporting structure 20. The third actuator 38 comprises a pair of third hydraulic cylinders 68 which are each pivotally connected at one end thereof to the lateral tilt frame 58 while the other ends are pivotally attached to the back section 30. As such, the actuation of third hydraulic cylinders 68 allows back section 30 to be pivoted up and down relative to lateral tilt framework 58 as shown in FIG. 11.

The fourth actuator 40 includes a fourth hydraulic cylinder 70. Hydraulic cylinder 70 is pivotally attached at one end to the seat section 32. The barrel portion of fourth hydraulic cylinder 70 is pivotally supported by a bracket 72 which extends from lateral tilt framework 58. As such, the actuation of fourth hydraulic cylinder 70 causes seat section 32 to be pivoted about hinge 66 relative to lateral tilt framework 58.

Figure 12:
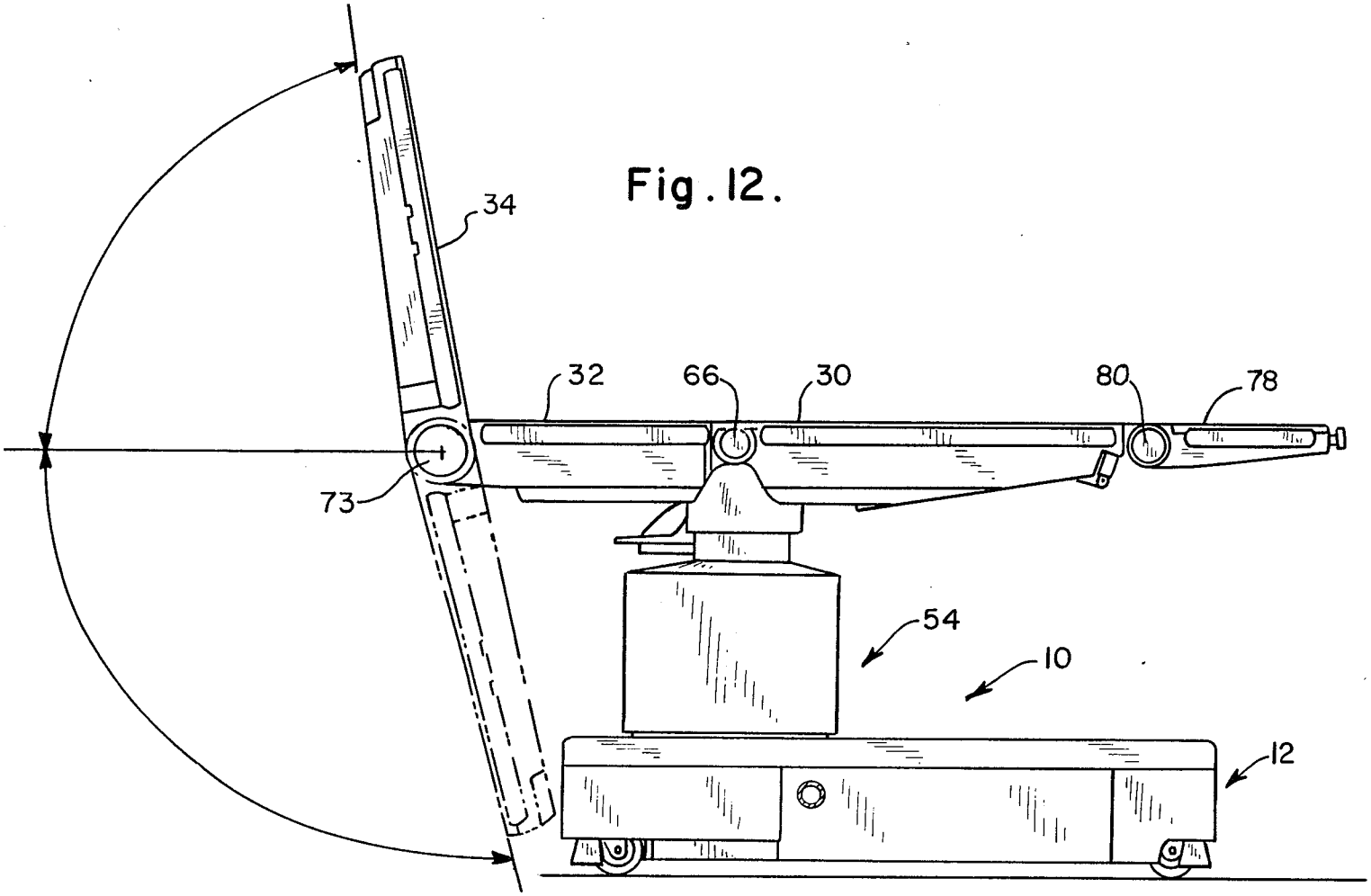
FIG. 12 is a side elevation view of the present surgical table showing its leg up and leg down positions.

The leg section of surgical table 10 is pivotally attached to the seat section 32 by means of the third pivot means 36. Third pivot means 36 will preferably comprise a hinge 73. The leg section 34 may be pivoted relative to the seat section 32 by means of the fifth actuator 42 which may comprise a pair of fifth hydraulic cylinders 74 which are connected between seat section 32 and leg section 34. Accordingly, the actuation of fifth hydraulic cylinders 74 causes the pivoting of leg section 34 about hinge means 73 relative to seat section 32 as shown in FIG. 12.

The back section 30 of surgical table 10 may be so extended as to include a head supporting section. Alternatively, an auxiliary head supporting section 78 may be pivotally attached to back section 30 by means of a hinge means 80. Hinge means 80 is typically manually adjustable to achieve the desired positioning of head section 78 relative to back section 30.

Figure 13:
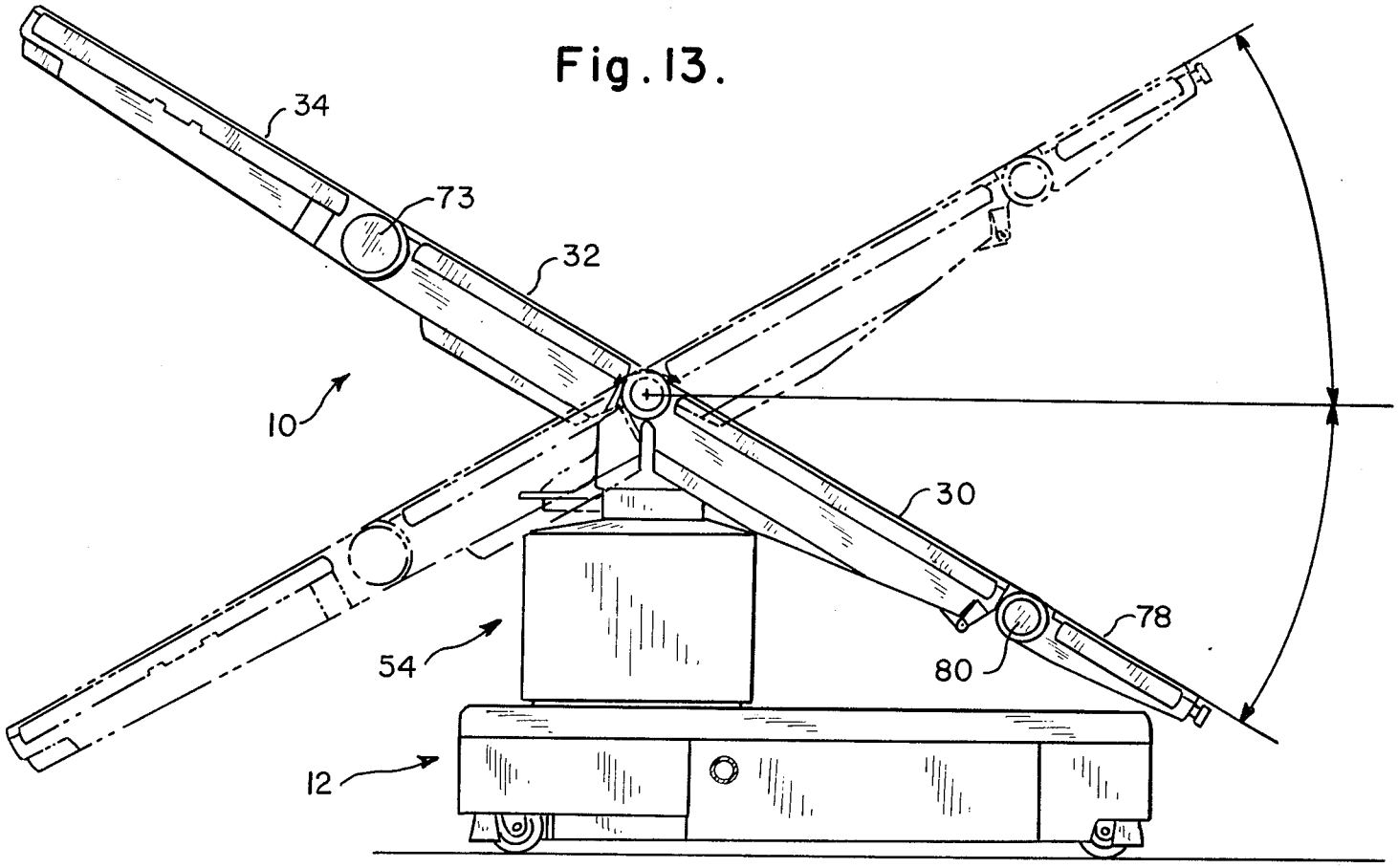
FIG. 13 is a side elevation view of the instant surgical table showing its Trendelenburg and reverse Trendelenburg positions.
Figure 14:
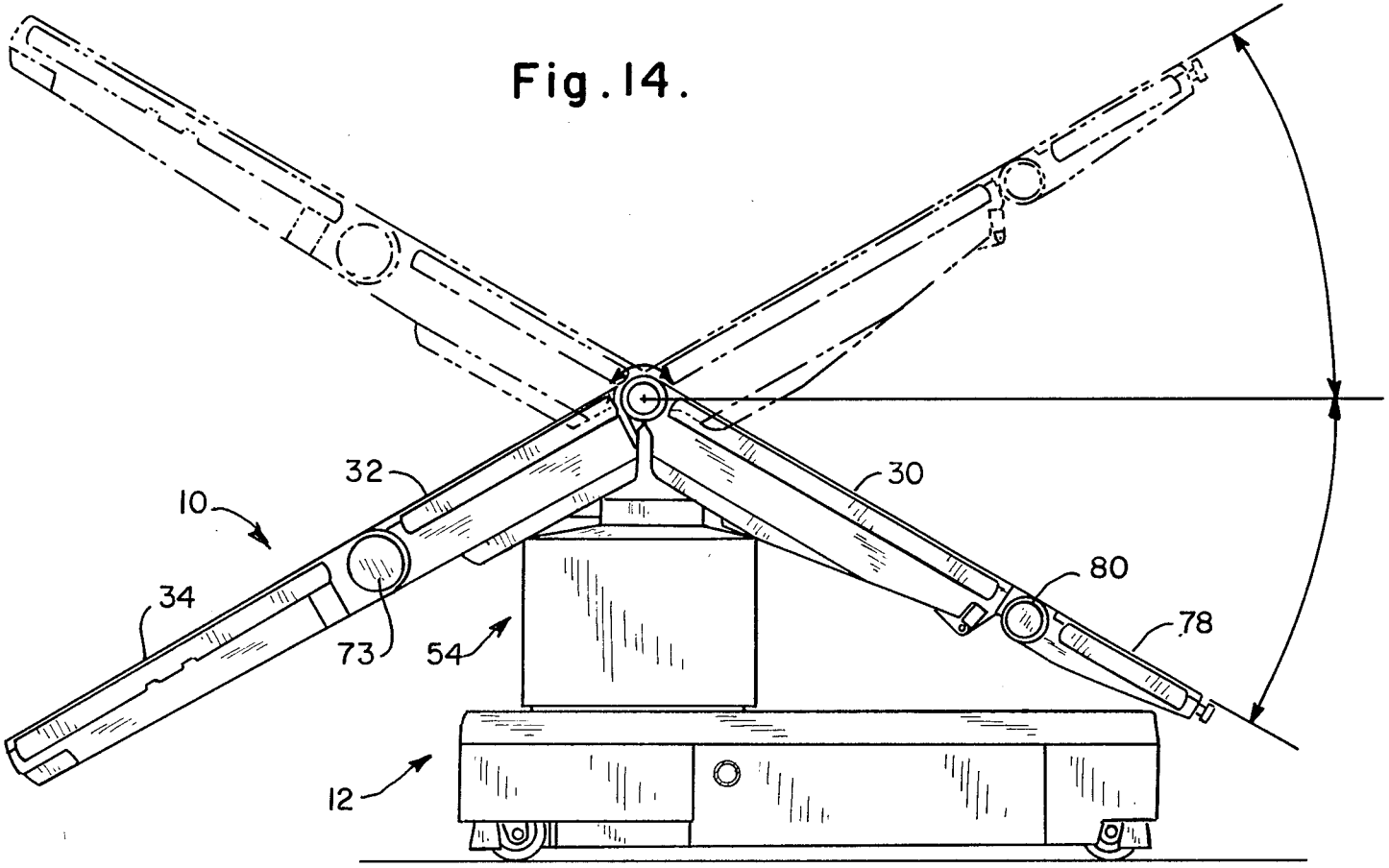
FIG. 14 is a side elevation view of the surgical table according to the present invention showing its flex and reflex positions.

The surgical table 10 constructed according to the present invention is also capable of providing Trendelenburg, reverse Trendelenburg, flex and reflex positions for supporting a surgical patient. The Trendelenburg position is achieved by the simultaneous coordinated actuation of third hydraulic cylinders 68 and fourth hydraulic cylinder 70 under the control of the control means discussed below. As third hydraulic cylinders 68 retract thereby lowering back section 30, fourth hydraulic cylinder 70 is extended at the same rate of motion to elevate the seat section. Conversely, in order to achieve the reverse Trendelenburg position, third hydraulic cylinders 68 are extended thereby raising back section 30 while the fourth hydraulic cylinder 70 is retracted to lower the seat section 32 at the same rate of motion. The Trendelenburg (solid lines) and reverse Trendelenburg (dashed lines) positions are depicted in FIG. 13. Surgical table 10 may also be manipulated to the flex position by the actuation of third hydraulic cylinders 68 and fourth hydraulic cylinder 70. In order to achieve the flex position, third hydraulic cylinders 68 are retracted thereby lowering the back section 30. Simultaneously, the fourth hydraulic cylinder 70 is retracted at a more rapid rate thereby lowering the seat section 32 but at an increased rate of motion relative to back section 30. To achieve the reflex position, the fourth hydraulic cylinder 70 is extended thereby elevating the seat section 32. Simultaneously, the third hydraulic cylinders 68 are extended thereby raising the back section 30. However, the elevation of the back section 30 proceeds at a slower rate than the elevation of seat section 32 due to the configuration of the control means discussed below. The flex (solid lines) and reflex (dashed lines) positions of surgical table 10 are depicted in FIG. 14.

Figure 15:
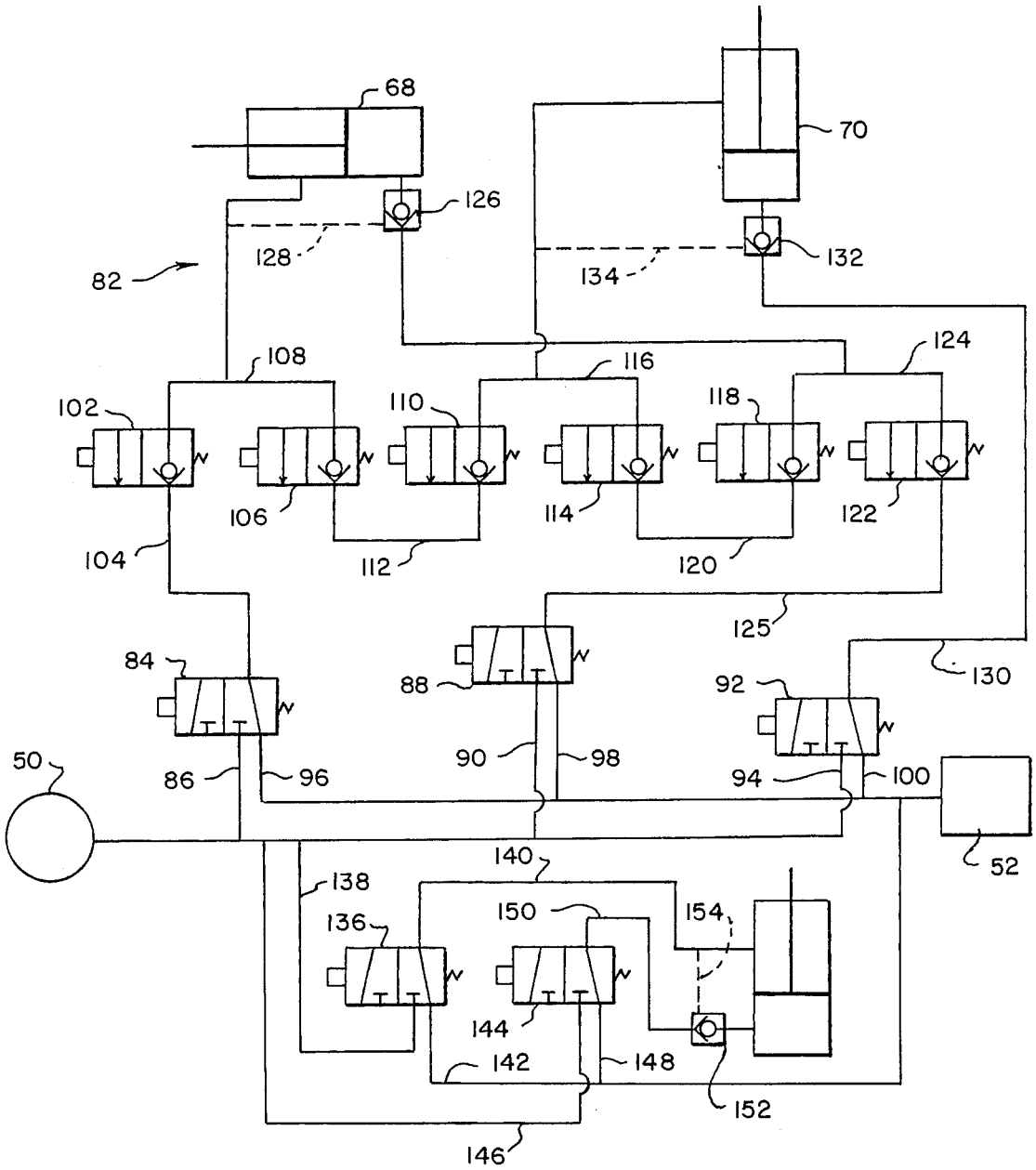
FIG. 15 is a schematic representation of certain hydraulic components of the present invention in their static condition.
Figure 16:
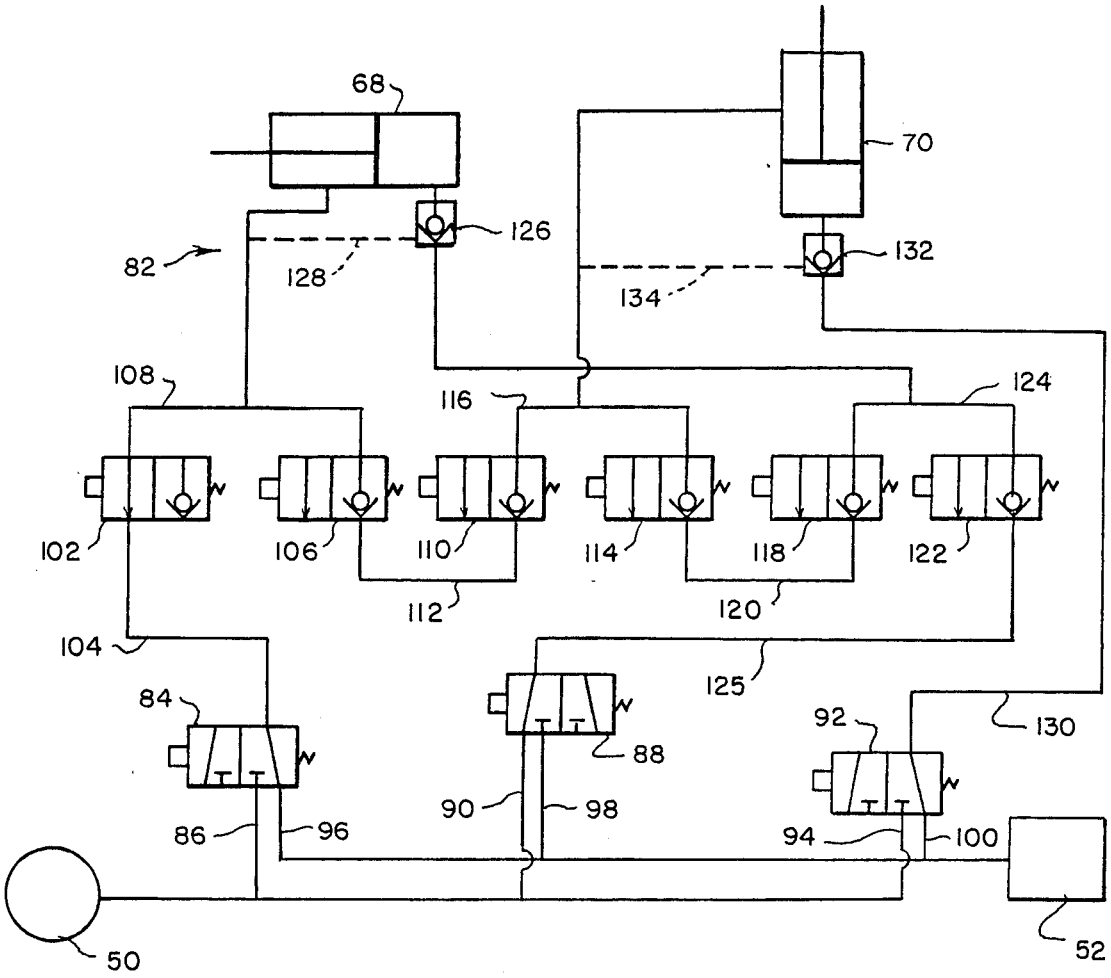
FIG. 16 is a schematic representation of certain of the hydraulic components of the present invention for yielding the back up position.
Figure 17:
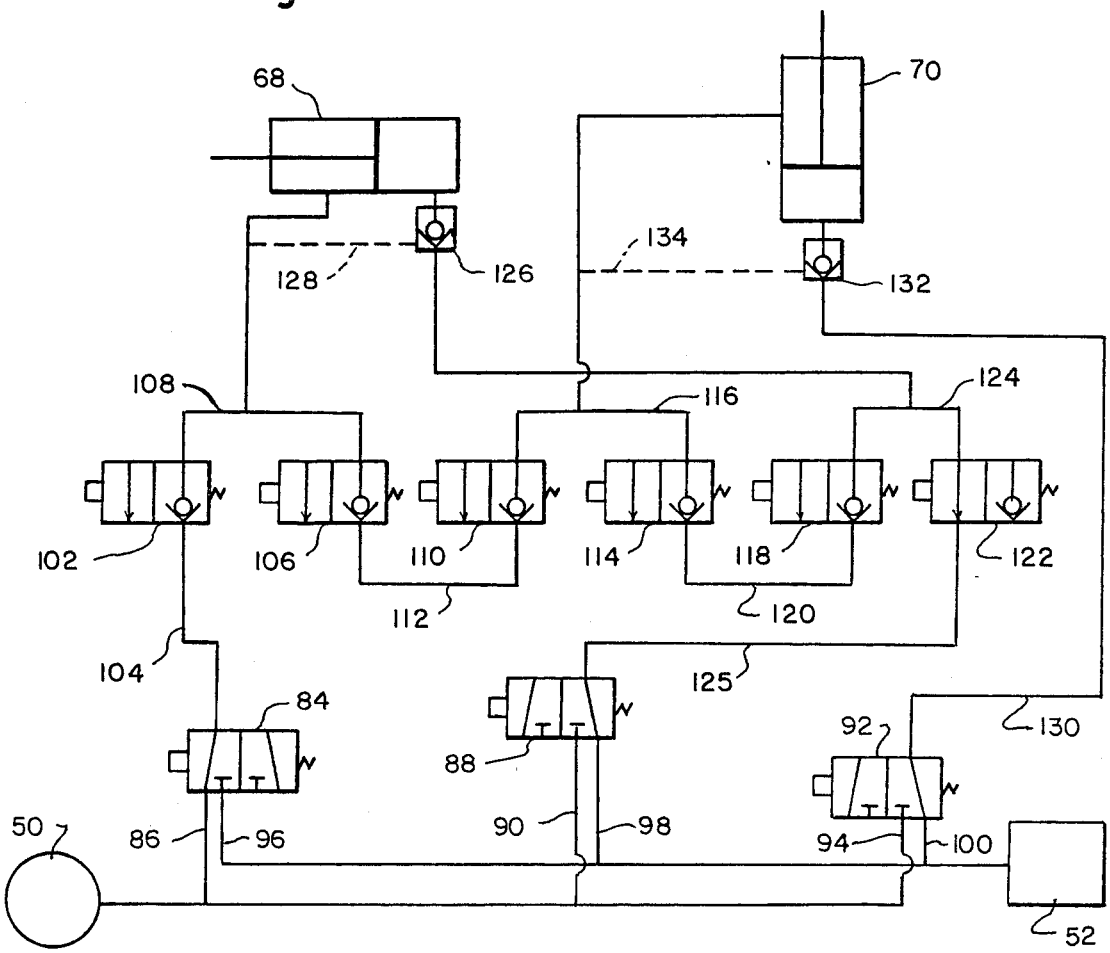
FIG. 17 is a schematic representation of certain of the hydraulic components of the present invention for yielding the back down position.
Figure 18:
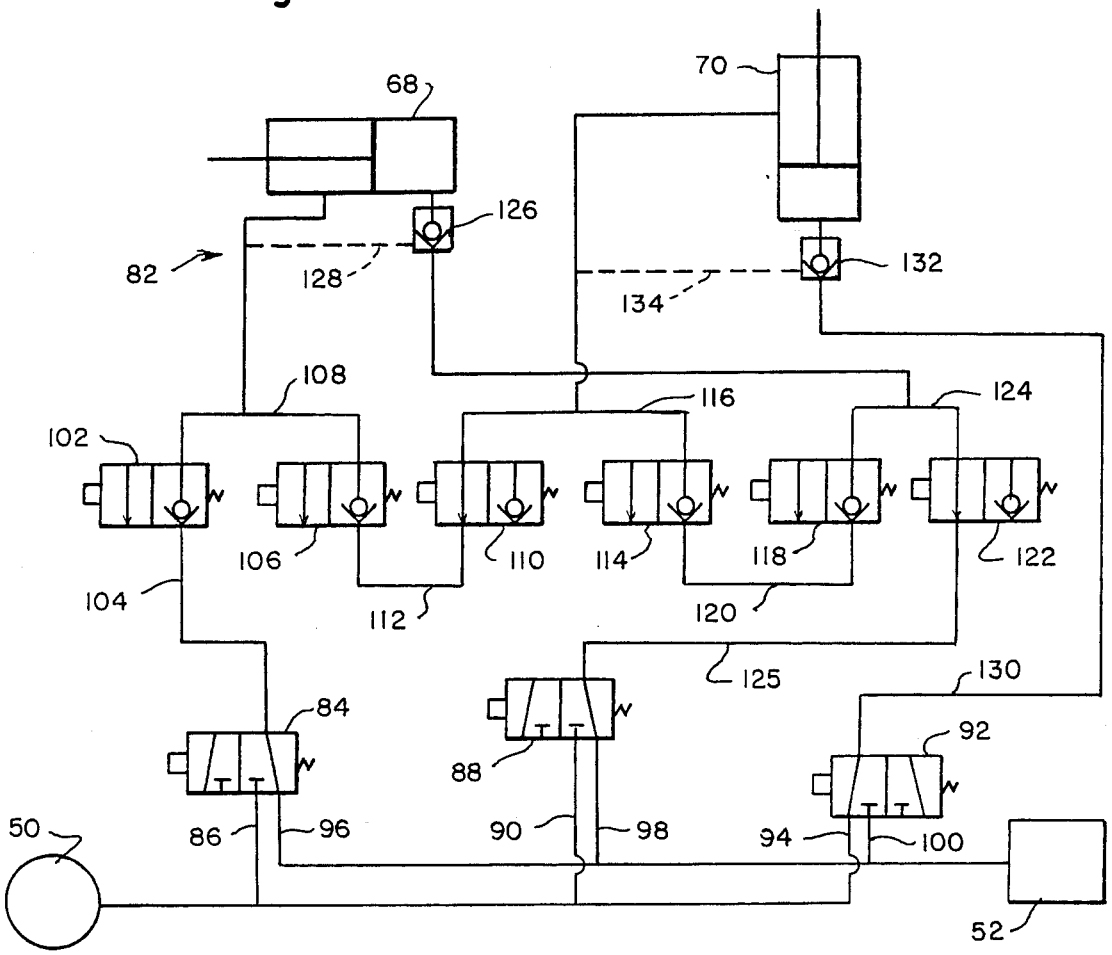
FIG. 18 is a schematic representation of certain of the hydraulic components of the present invention intended to yield the Trendelenburg position.
Figure 19:
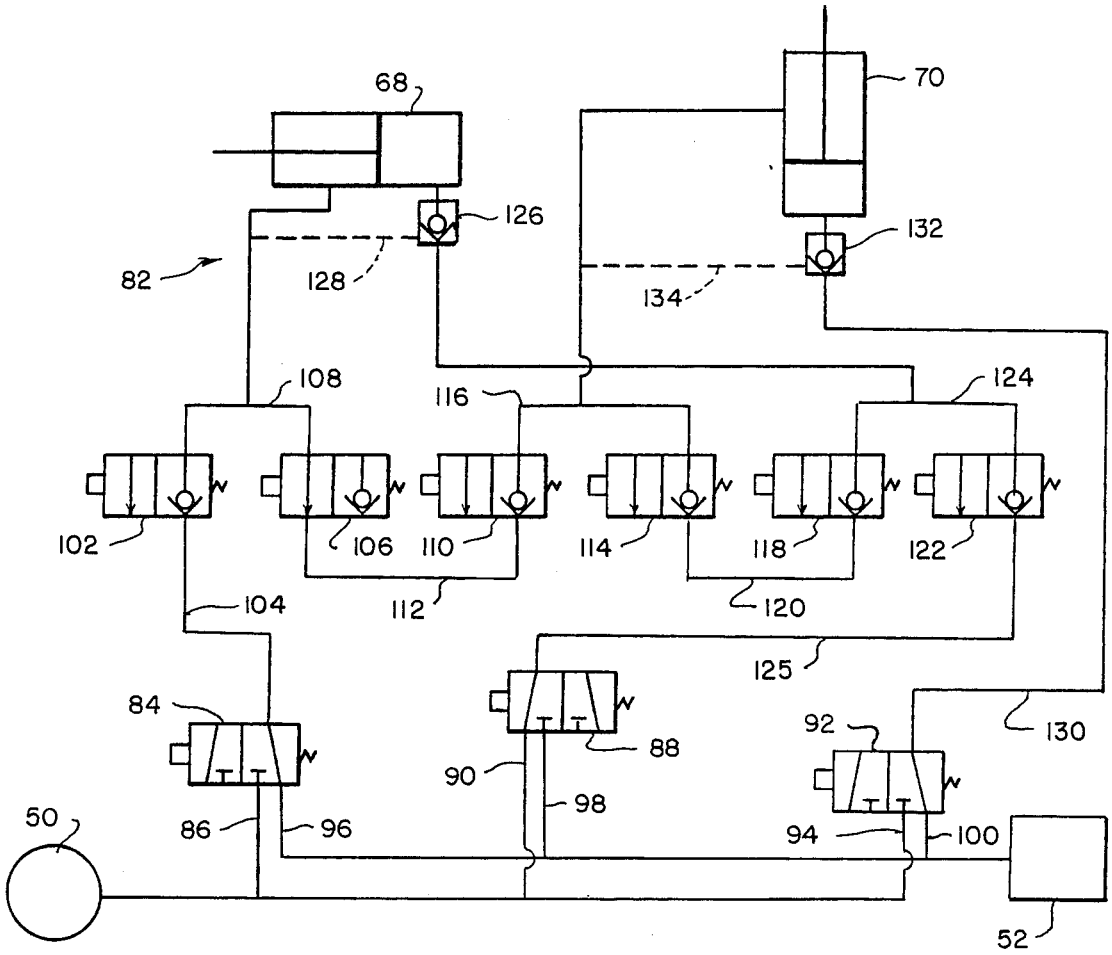
FIG. 19 is a schematic representation of certain of the hydraulic components of the present invention for yielding the reverse Trendelenburg position.
Figure 20:
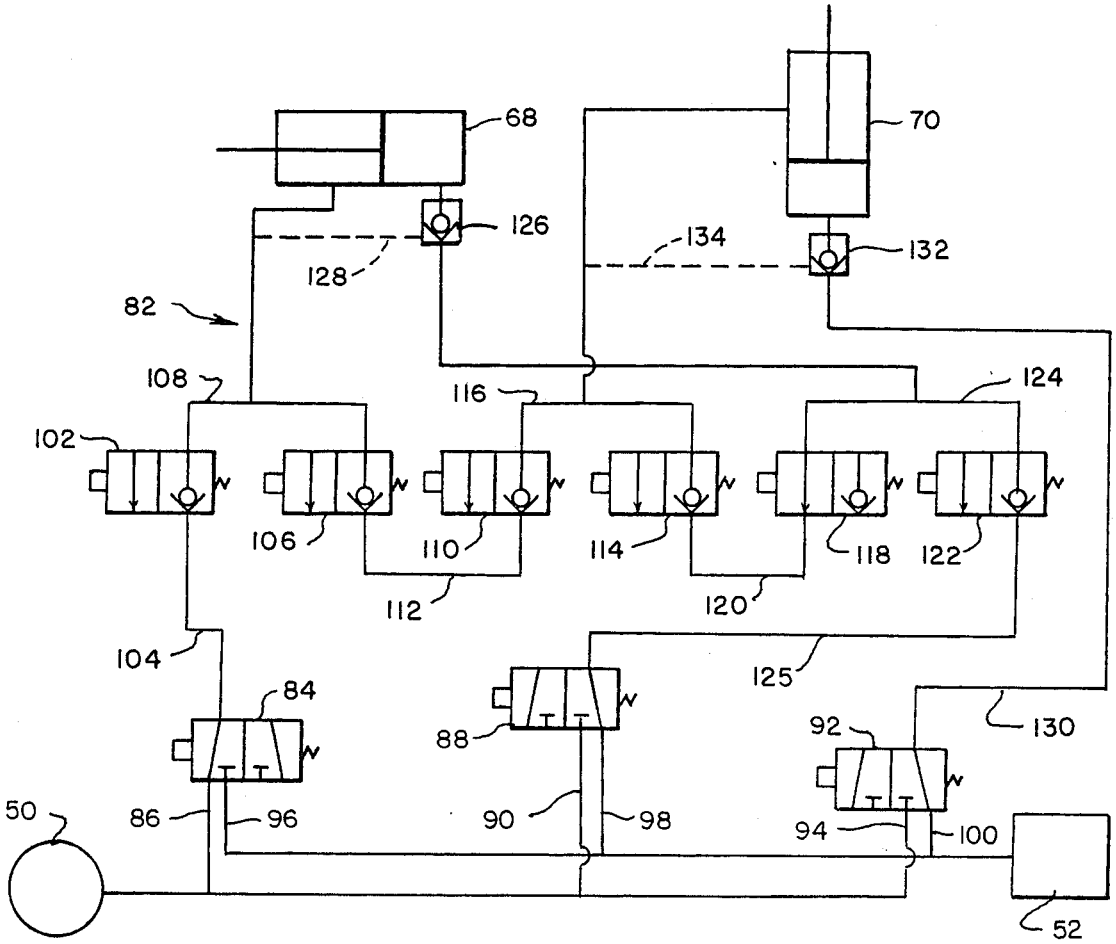
FIG. 20 is a schematic representation of certain of the hydraulic components of the present invention for yielding the flex position.
Figure 21:
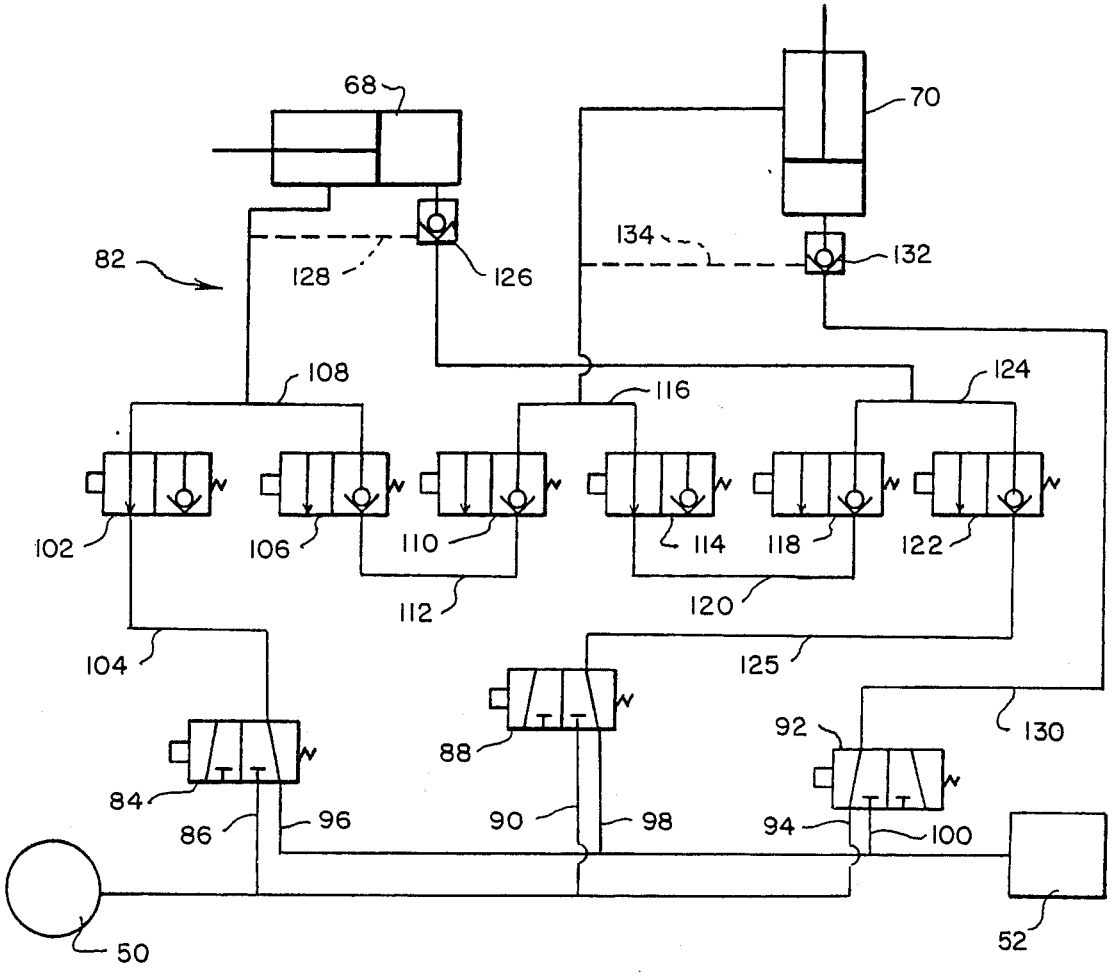
FIG. 21 is a schematic representation of certain of the components of the present invention for yielding the reflex position.
Figure 22:
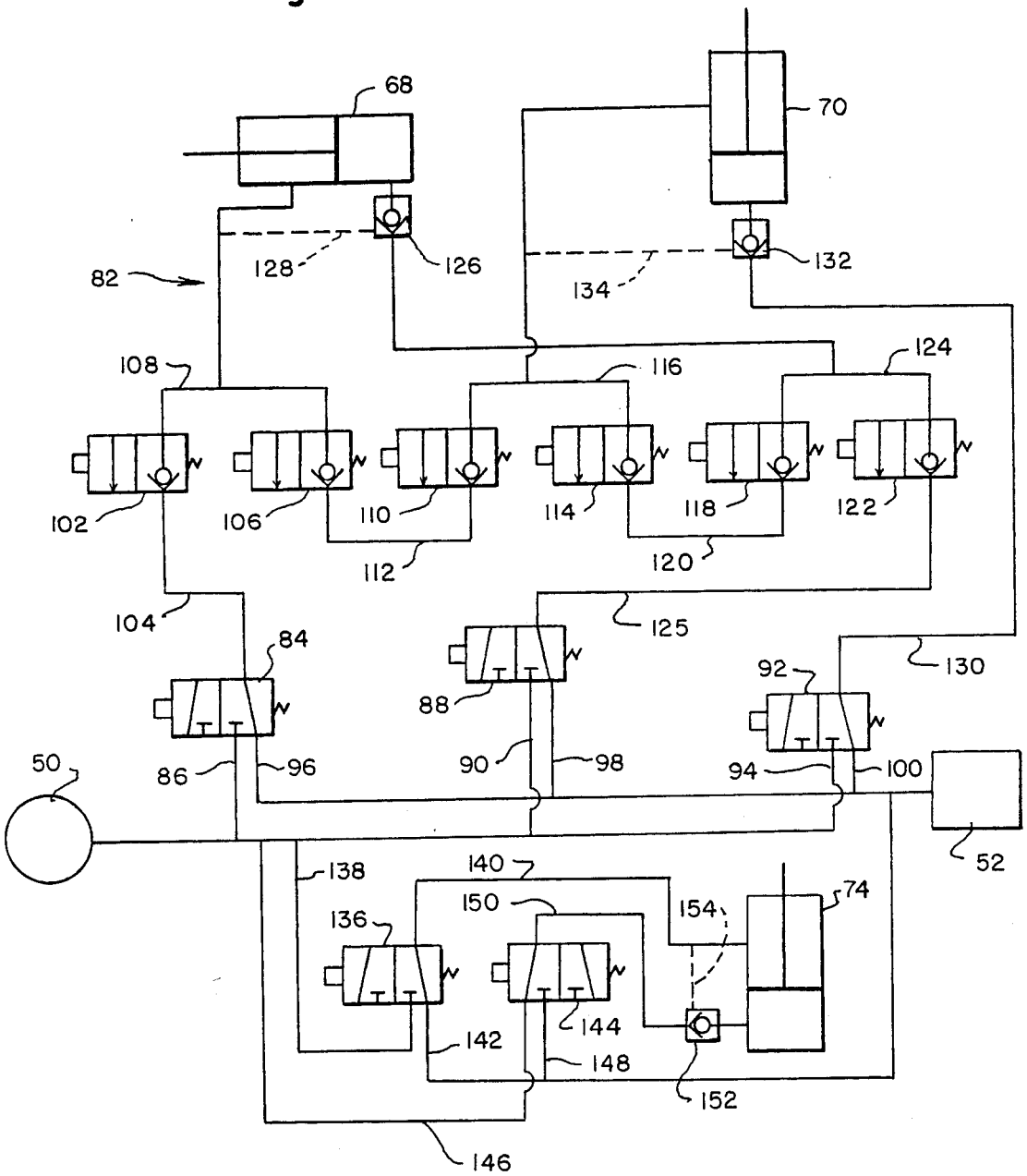
FIG. 22 is a schematic representation of certain of the components of the present invention for yielding the leg up position.
Figure 23:
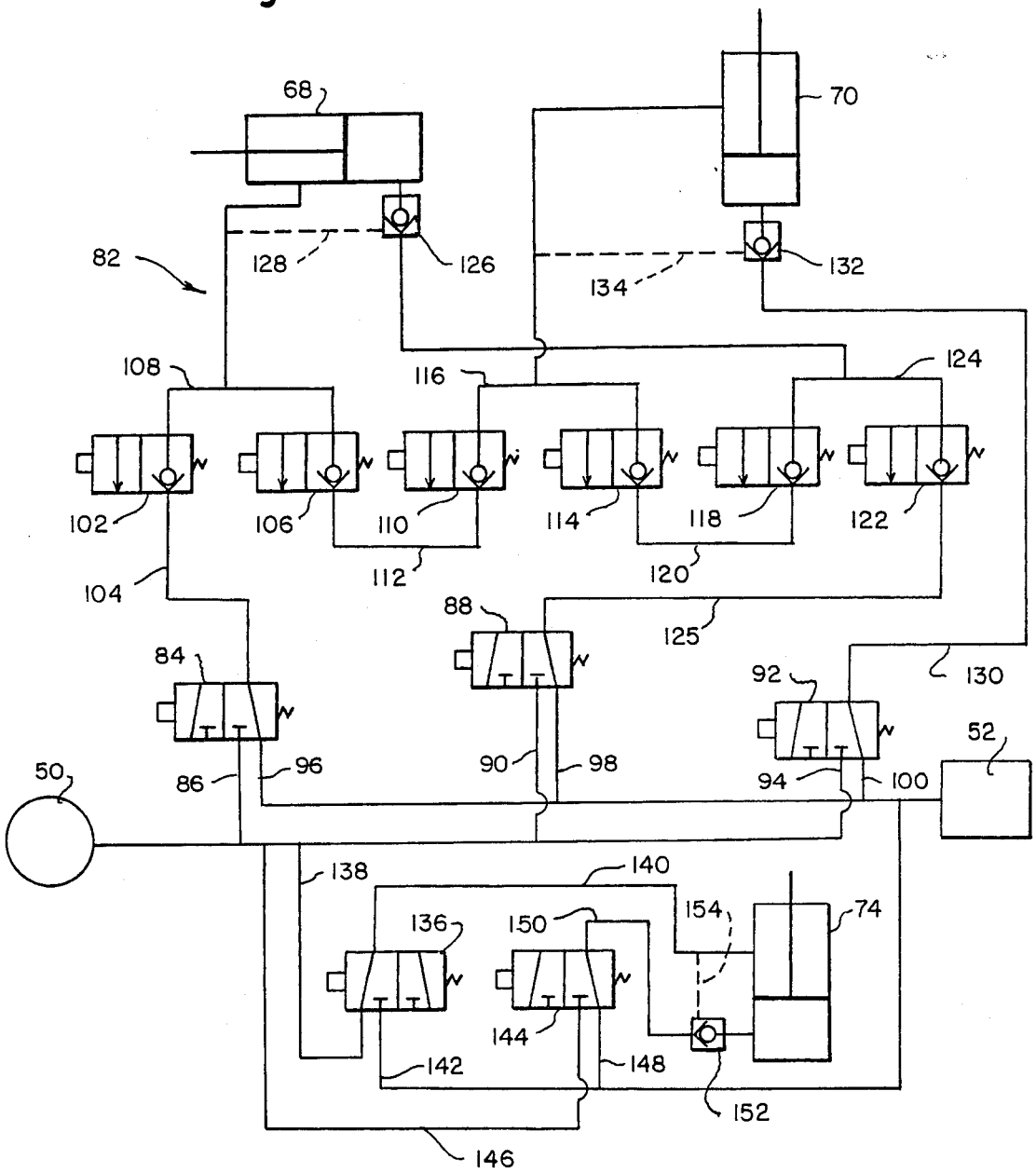
FIG. 23 is a schematic representation of certain of the components of the present invention for yielding the leg down position.

The control mechanism for controlling the actuation of third hydraulic cylinders 68, fourth hydraulic cylinder 70 and fifth hydraulic cylinders 74 will now be discussed. Such control means, generally indicated by the numeral 82, is shown in its static position in FIG. 15. Control means 82 includes a first electric solenoid controlled double acting valve 84 which is connected by means of a hydraulic line 86 to the pressurized output of pump 50. Control means 82 also includes a second electric solenoid controlled double acting valve 88 which may be coupled to the output of pump 50 by means of a hydraulic line 90. In addition, control means 82 includes a third electric solenoid controlled double acting valve 92 which may be connected to the output of pump 50 by means of hydraulic line 94. First solenoid valve 84 is also connected to the reservoir 52 by means of a hydraulic line 96. Similarly second and third electric solenoid valves 88 and 92, respectively, may be connected to the reservoir 52 by means of hydraulic lines 98 and 100, respectively.

First electric solenoid valve 84 is also connected to a first two-way electric solenoid controlled valve 102 by means of hydraulic line 104. First two-way valve 102 is also connected to a second electric solenoid controlled two-way valve 106 by means of a hydraulic line 108. Hydraulic line 108 is additionally connected to the rod ends of third hydraulic cylinders 68. Second electric solenoid controlled two-way valve 106 is connected to a third electric solenoid controlled two-way valve 110 by means of a hydraulic line 112. Third two-way valve 110 is additionally connected to a fourth electric solenoid controlled two-way valve 114 by means of a hydraulic line 116. Hydraulic line 116 is also connected to the rod end of fourth hydraulic cylinder 70. Fourth electric solenoid controlled two-way valve 114 is connected to a fifth electric solenoid controlled two-way valve 118 by means of a hydraulic line 120. Fifth two-way valve 118 is connected to a sixth electric solenoid controlled two-way valve 122 by means of a hydraulic line 124. Sixth two-way valve 122 is also connected to the second double acting valve 88 by a line 125. Hydraulic line 124 is also connected to the cap ends of third hydraulic cylinders 68 by means of a first pilot actuated check valve 126 which is connected by means of a pilot line 128 to hydraulic line 108. An additional hydraulic line 130 is connected between third electric solenoid controlled valve 92 and a second pilot operated check valve 132. Second check valve 132 is operated by means of a pilot line 134 connected to line 116 and is also connected to the cap end of fourth hydraulic cylinder 70.

In order to pivot the leg section 34 relative to the seat section 32 about pivot means 73, fifth hydraulic cylinders 74 are employed. The actuation of fifth hydraulic cylinders 74 is also controlled by means of control means 82. In particular, a fourth electric solenoid controlled dual acting valve 136 is connected to the pressurized output of pump 50 by means of a hydraulic line 138. Fourth dual acting valve 136 is also connected to the rod ends of fifth hydraulic cylinders 74 by means of hydraulic line 140. Further, fourth dual acting valve 136 is connected to the reservoir 52 by means of a hydraulic line 142. A fifth dual acting electric solenoid controlled valve 144 is connected to the pressurized output of hydraulic pump 50 by means of a hydraulic line 146. Fifth dual acting valve 144 is also connected by means of hydraulic line 148 to the reservoir 52. In addition, fifth dual acting valve 144 is connected by means of a hydraulic line 150 to a third pilot actuated check valve 152 which, in turn, is connected to the cap end of fifth hydraulic cylinders 74. Third check valve 152 is also connected by means of a pilot line 154 to hydraulic line 140. The actual control of first double acting valve 84, second double acting valve 88, third double acting valve 92, fourth double acting valve 136 and fifth double acting valve 144, as well as the six two-way valves 102, 106, 110, 114, 118 and 122, respectively, to achieve the functions described herein is provided by means of a suitable electrical control means. Such control means is effective to control the actuation of such valves in the following manner.

To achieve the raising of back section 30 by means of the extension of third hydraulic cylinders 68, second double acting valve 88 and first two-way valve 102 are actuated. The actuation of such valves causes hydraulic fluid from pump 50 to be supplied through line 90 through second double acting valve 88 and through hydraulic line 125 to sixth two-way valve 122. Hydraulic fluid from sixth two-way valve 122 then passes through hydraulic line 124 and check valve 126 to the cap ends of third hydraulic cylinders 68. The hydraulic fluid displaced from the rod ends of third hydraulic cylinders 68 passes through hydraulic line 108, through first two-way valve 102, through hydraulic line 104, through first double acting valve 84 and through hydraulic line 96 to the reservoir 52.

In order to cause back section 30 to be lowered, the rod ends of third hydraulic cylinders 68 must be retracted. Accordingly, first double acting valve 86 and sixth two-way valve 122 are actuated. The actuation of such valves causes hydraulic fluid provided from pump 50 to pass through hydraulic line 86, through first double acting valve 84, through line 104, through first two-way valve 102 and through line 108 to the rod ends of third hydraulic cylinders 68 so as to cause the retraction of the rods thereof. Because hydraulic fluid pressure is present in line 108, such pressure is transmitted by means of pilot line 128 to cause the opening of pilot valve 126. As such, the hydraulic fluid displaced from the cap ends of third hydraulic cylinders 68 passes through check valve 126, through line 124, through sixth two-way valve 122, through line 125, through second double acting valve 88 and through line 98 to the reservoir 52.

As stated above, for the surgical table 10 to be positioned in the Trendelenburg position, the back section 30 must be lowered by third cylinders 68 while the seat section 32 is raised by fourth cylinder 70. Such movement is accomplished by the actuation of third double acting valve 92, third two-way valve 110 and sixth two-way valve 122. Upon the actuation of such valves, hydraulic fluid provided by pump 50 passes through line 94, through third two-way valve 92, through line 130, and through check valve 132 to the cap end of fourth hydraulic cylinder 70. The hydraulic fluid displaced from rod end of fourth hydraulic cylinder 70, passes through line 116 to third two-way valve 110. Such hydraulic fluid then passes through line 112, through second two-way valve 106, and through line 108 to the rod ends of third hydraulic cylinders 68. Because hydraulic fluid is present in line 108, pressure is provided through hydraulic pilot line 128 to check valve 126 thereby causing its opening. This action allows the hydraulic fluid displaced from the cap ends of third hydraulic cylinders 68 to pass through check valve 126, through line 124, through sixth two-way valve 122, through hydraulic line 125, through second double acting valve 88 and through hydraulic line 98 to the reservoir 52.

In order for the surgical table 10 to be disposed in the reverse Trendelenburg position, second double acting valve 88 and second two-way valve 106 are actuated. Such actuation causes hydraulic fluid from pump 50 to pass through line 90, through second double acting valve 88, through line 125, through sixth two-way valve 122, through hydraulic line 124 and through check valve 126 to the cap ends of third hydraulic cylinders 68. The hydraulic fluid displaced from the rod ends of third hydraulic cylinders 68 passes through hydraulic line 108, through second two-way valve 106, through line 112, through third two-way valve 110 and through hydraulic line 116 to the rod end of fourth hydraulic cylinder 70. Because hydraulic fluid pressure is present in line 116, pilot line 134 provides pilot pressure to open second check valve 132. Such opening allows hydraulic fluid displaced from the cap end of fourth hydraulic cylinder 70 to pass through check valve 132, through line 130, through third double acting valve 92 and through line 100 to the reservoir 52. It will be appreciated that when surgical table 10 is caused to enter the Trendelenburg and reverse Trendelenburg positions, the seat section 30 and the back section 32 move at the same rate because the rod ends of third cylinders 68 are connected to the rod end of fourth cylinder 70 or the cap ends of third cylinders 68 are connected to the cap end of fourth cylinder 70, as the case may be.

The surgical table 10 may also be disposed in the flex position in which the back section 30 and the seat section 32 are both lowered by means of the retraction of the rods of the third hydraulic cylinders 68 and the fourth hydraulic cylinder 70, respectively. To accomplish the flex position, first double acting valve 84 and fifth two-way valve 118 are actuated. The actuation of those valves causes pressurized hydraulic fluid from pump 50 to pass through line 86, through first double acting valve 84, through line 104, through first two-way valve 102 and through line 108 to the rod ends of third hydraulic cylinders 68. Because hydraulic fluid pressure is present in line 108, pilot line 128 may provide hydraulic fluid to first check valve 126 so as to cause its opening. The opening of check valve 126 allows the hydraulic fluid displaced from the cap ends of third hydraulic cylinders 68 to pass through check valve 126, through line 124, through fifth two-way valve 118, through hydraulic line 120, through fourth two-way valve 114 and through hydraulic line 116 to the rod end of fourth hydraulic cylinder 70. Because hydraulic fluid pressure is present in hydraulic line 116, such pressure may be passed by means of hydraulic pilot line 134 to second check valve 132 so as to cause its opening. This action enables the hydraulic fluid displaced from the cap end of fourth hydraulic cylinder 70 to pass through second check valve 132, through hydraulic line 130, through third double acting valve 92 and through hydraulic line 100 to the reservoir 52. It will be appreciated however, that when surgical table 10 is moving into the flex position, the seat section 32 moves at a faster rate than the back section. This is so because the hydraulic fluid displaced from the cap ends of the third hydraulic cylinders 68 is provided to the rod end of the fourth hydraulic cylinder 70. Because the volume of the cap ends of the third hydraulic cylinders 68 is greater than the volume of the rod end of fourth hydraulic cylinder 70, the seat section 32 moves at a faster rate than the back section 30.

The surgical table 10 may also achieve the reflex position by the actuation of third double acting valve 92, first two-way valve 102 and fourth two-way valve 114, all under the control of controller 82. Upon the actuation of those valves, the hydraulic fluid provided by pump 50 passes through line 94, through third double acting valve 92, through hydraulic line 130 and through check valve 132 to the cap end of fourth hydraulic cylinder 70. The hydraulic fluid displaced from the cap end of fourth hydraulic cylinder 70 passes through line 116, through fourth two-way valve 114, through hydraulic line 120, through fifth two-way valve 118, through hydraulic line 124 and through check valve 126 to the cap ends of the third hydraulic cylinders 68. The hydraulic fluid displaced from the cap ends of third hydraulic cylinder 68 passes through hydraulic line 108, through first two-way valve 102, through hydraulic line 104, through first double acting valve 84 and through line 96 to the reservoir 52. Because the volume of the rod end of fourth hydraulic cylinder 70 is less than that of the cap ends of third hydraulic cylinders 68, the seat section 32 moves at a more rapid rate than the back section 30.

The control means 82 may also control the pivoting of the leg section 34 relative to the seat section 32 by means of the actuation of fifth hydraulic cylinders 74. In order to cause the leg section 28 to be raised, fifth double acting valve 144 is actuated. Such actuation enables hydraulic fluid provided by pump 50 to pass through hydraulic line 146, through fifth double acting valve 144, through hydraulic line 150 and through check valve 152 to the cap ends of fifth hydraulic cylinders 74. Fluid displaced from the rod ends of fifth hydraulic cylinder 74 passes through hydraulic line 140 through fourth double acting valve 136 and through hydraulic line 142 to the reservoir 52.

In order to effectuate the lowering of the leg section 34 relative to the seat section 32, the fourth double acting valve 136 is actuated. Such actuation enables hydraulic fluid to pass from pump 50, through hydraulic line 138, through fourth double acting valve 136 and through hydraulic line 140 to the rod end of fifth hydraulic cylinders 74 so as to cause their retraction. Because hydraulic fluid is present in hydraulic line 140, pilot fluid pressure is present in pilot line 154 to open third check valve 152. The opening of third check valve 152 enables the hydraulic fluid displaced from the cap ends of fifth hydraulic cylinders 74 to pass through third check valve 152, through hydraulic line 150, through fifth double acting valve 144 and through line 148 to the reservoir 52.

By virtue of the configuration of the surgical table 10, the complete range of surgical table movements may be accomplished with a minimum number of function levels, pivot points and actuators. Specifically, surgical table 10 may accomplish the complete range of surgical table movements by using only three function levels, three pivot points and five actuators.

It will be understood that various changes in the details, materials and arrangements of parts which have been herein described and illustrated in order to explain the nature of the invention may be made by those skilled in the art within the principle and scope of the invention as expressed in the appended claims.

What is claimed is:

1. A surgical table, comprising:

an articulated table top having a back section connected to a seat section by a hinge means;

means supporting said table top;

first means for pivoting said back section about said hinge means;

second means for pivoting said seat section about said hinge means;

control means for coordinating the operation of said first and second means such that said back section may be pivoted in one direction while said seat section is simultaneously pivoted in the opposite direction.

2. The surgical table of claim 1 wherein said first means for pivoting includes a first hydraulic cylinder having a cap end and a rod end and wherein said second means for pivoting includes a second hydraulic cylinder having a cap end and a rod end.

3. The surgical table of claim 2 additionally comprising a source of hydraulic fluid and a drain for hydraulic fluid, and wherein said control means includes a plurality of hydraulic valves for interconnecting said cap ends and said rod ends of said first and second hydraulic cylinders with each other and said source and drain.

4. The surgical table of claim 3 wherein said plurality of hydraulic valves may connect said cap end of said second hydraulic cylinder to said source, to connect said rod end of said second hydraulic cylinder to said rod end of said first hydraulic cylinder, and to connect said cap end of said first hydraulic cylinder to said drain such that said back section is downwardly pivoting as said seat section is upwardly pivoting whereby said surgical table provides a Trendelenburg position.

5. The surgical table of claim 4 wherein said plurality of hydraulic valves may connect said cap end of said first hydraulic cylinder to said source, may connect said rod end of said first hydraulic cylinder to said rod end of said second hydraulic cylinder and may connect said cap end of said second hydraulic cylinder to said source such that said back section is upwardly pivoting as said seat section is downwardly pivoting whereby said surgical table provides a reverse Trendelenburg position.

6. The surgical table of claim 5 wherein said plurality of hydraulic valves may connect said rod end of said first hydraulic cylinder to said drain and said cap end of said first hydraulic cylinder to said source such that said back section is upwardly pivoting independently of said seat section.

7. The surgical table of claim 6 wherein said plurality of hydraulic valves may connect said rod end of said first hydraulic cylinder to said source and said cap end of said first hydraulic cylinder to said drain such that said back section is downwardly pivoting independently of said seat section.

8. The surgical table of claim 7 wherein said table top includes a leg section connected to said seat section, said leg section moving in unison with said seat section during said Trendelenburg and reverse Trendelenburg motions.

9. The surgical table of claim 8 wherein said connection between said seat and leg sections includes a second hinge means, said surgical table additionally comprising a third hydraulic cylinder for pivoting said leg section, said third cylinder having a cap end and a rod end and being connected between said seat section and said leg section.

10. The surgical table of claim 9 wherein said plurality of hydraulic valves may connect said rod end of said third hydraulic cylinder to said drain and said cap end of said third hydraulic cylinder to said source such that said leg section is upwardly pivoted independently of said back and seat sections.

11. The surgical table of claim 10 wherein said plurality of hydraulic valves may connect said rod end of said third hydraulic cylinder to said source and said cap end of said third hydraulic cylinder to said drain such that said leg section is downwardly pivoted independently of said back and seat sections.

12. The surgical table of claim 3 wherein said plurality of hydraulic valves may connect said rod end of said first hydraulic cylinder to said source, may connect said cap end of said first hydraulic cylinder to said rod end of said second hydraulic cylinder, and may connect said cap end of said second hydraulic cylinder to said drain such that said back section is downwardly pivoted as said seat section is downwardly pivoted whereby said surgical table provides a flex position.

13. The surgical table of claim 12 wherein said plurality of hydraulic valves may connect said cap end of said second hydraulic cylinder to said source, may connect said rod end of said second hydraulic cylinder to said cap end of said first hydraulic cylinder and may connect said rod end of said first hydraulic cylinder to said drain such that said back section is upwardly pivoted as said seat section is upwardly pivoted whereby said surgical table provides a reflex position.

14. The surgical table of claim 13 wherein said plurality of hydraulic valves may connect said rod end of said first hydraulic cylinder to said drain and said cap end of said first hydraulic cylinder to said source such that said back section is upwardly pivoted independently of said seat section.

15. The surgical table of claim 14 wherein said plurality of hydraulic valves may connect said rod end of said first hydraulic cylinder to said source and said cap end of said first hydraulic cylinder to said drain such that said back section is downwardly pivoted independently of said seat section.

16. The surgical table of claim 15 wherein said table top includes a leg section connected to said seat section, said leg section moving in unison with said seat section during said flex and reflex motions.

17. The surgical table of claim 16 wherein said connection between said seat and leg sections includes a second hinge means, said surgical table additionally comprising a third hydraulic cylinder for pivoting said leg section, said third cylinder having a cap end and a rod end and being connected between said seat section and said leg section.

18. The surgical table of claim 17 wherein said plurality of hydraulic valves may connect said rod end of said third hydraulic cylinder to said drain and said cap end of said third hydraulic cylinder to said source such that said leg section is upwardly pivoted independently of said seat section.

19. The surgical table of claim 18 wherein said plurality of hydraulic valves may connect said rod end of said third hydraulic cylinder to said source and said cap end of said third hydraulic cylinder to said drain such that said leg section is downwardly pivoted independently of said seat section.

20. The surgical table of claim 1 wherein said means for supporting said table top includes a column having an adjustable height.

21. The surgical table of claim 20 additionally comprising a hydraulic cylinder for adjusting the height of said column.

22. The surgical table of claim 1 wherein said hinge means includes a hinge means laterally pivotally connecting said table top to said means for supporting said table top.

23. The surgical table of claim 22 additionally comprising a hydraulic cylinder for tilting said table from side to side.

24. The surgical table of claim 1 wherein said means supporting said table top includes a vertical column, and wherein said first means for pivoting is mounted perpendicular to said vertical column and second means for pivoting is mounted parallel to said vertical column.

25. The surgical table of claim 1 wherein said means supporting said table top includes a vertical column, and wherein said first and second means for pivoting are mounted perpendicular to said vertical column.

26. The surgical table of claim 1 wherein said means supporting said table top includes a vertical column, and wherein said first and second means for pivoting are mounted parallel to said vertical column.

* * * * *